US009745818B2

(12) United States Patent
Broussard et al.

(10) Patent No.: US 9,745,818 B2
(45) Date of Patent: Aug. 29, 2017

(54) DOWNHOLE ISOLATION METHODS AND APPARATUS THEREFOR

(71) Applicant: Swelltec Limited, Dyce, Aberdeen (GB)

(72) Inventors: John Broussard, Houston, TX (US); Brian Nutley, Aberdeen (GB); Ross Clarke, Aberdeen (GB); Kim Nutley, Inverurie (GB)

(73) Assignee: Swelltec Limited, Dyce, Aberdeen (GB)

( * ) Notice: Subject to any disclaimer, the term of this patent is extended or adjusted under 35 U.S.C. 154(b) by 21 days.

(21) Appl. No.: 14/578,674

(22) Filed: Dec. 22, 2014

(65) Prior Publication Data

US 2015/0176364 A1 Jun. 25, 2015

Related U.S. Application Data

(62) Division of application No. 13/336,683, filed on Dec. 23, 2011, now Pat. No. 9,587,459.

(51) Int. Cl.
*E21B 33/124* (2006.01)
*E21B 33/12* (2006.01)
(Continued)

(52) U.S. Cl.
CPC ..... *E21B 33/1243* (2013.01); *E21B 33/1208* (2013.01); *E21B 34/06* (2013.01); *E21B 43/04* (2013.01); *E21B 43/14* (2013.01)

(58) Field of Classification Search
CPC .... E21B 43/04; E21B 33/122; E21B 33/1243; E21B 33/1208; E21B 34/06; E21B 43/14
See application file for complete search history.

(56) References Cited

U.S. PATENT DOCUMENTS 4,875,525 A 10/1989 Mana
7,562,709 B2 7/2009 Saebi et al.
(Continued)

FOREIGN PATENT DOCUMENTS

| | | |
|---|---|---|
| RU | 2395667 | 7/2010 |
| SU | 01712590 | 2/1992 |
| WO | 2012/084889 | 6/2012 |

OTHER PUBLICATIONS

Australian Office Action filed in U.S. counterpart Australian Application No. 2012261722 dated Mar. 14, 2014, 6 pages.

*Primary Examiner* — Wei Wang
(74) *Attorney, Agent, or Firm* — Blank Rome, LLP

(57) ABSTRACT

The invention provides a method and apparatus for use in a wellbore gravel pack operation. The method comprises providing an apparatus in a downhole annulus. The apparatus comprises a mandrel and a swellable element formed from a material selected to increase in volume when exposed to a downhole stimulus. The method comprises placing a gravel pack below the apparatus via the downhole annulus in which the apparatus is located, and placing a gravel pack above the apparatus. Subsequent to placing the gravel packs, the swellable element is increased in volume to create an annular barrier in the wellbore. The invention allows isolation of multiple intervals of a well in a single gravel pack operation using swellable elastomers, and does not rely on the use of shunt tube alternate path systems.

8 Claims, 19 Drawing Sheets

(51) Int. Cl.

| | |
|---|---|
| ***E21B 43/04*** | (2006.01) |
| ***E21B 34/06*** | (2006.01) |
| ***E21B 43/14*** | (2006.01) |

(56) References Cited

U.S. PATENT DOCUMENTS

| | | | | |
|---|---|---|---|---|
| 7,866,408 | B2 * | 1/2011 | Allison ..... | E21B 23/06 166/179 |
| 7,870,909 | B2 | 1/2011 | John et al. | |
| 2004/0007829 | A1 | 1/2004 | Ross | |
| 2007/0151724 | A1 | 7/2007 | Ohmer et al. | |
| 2008/0066900 | A1 | 3/2008 | Saebi et al. | |
| 2008/0164026 | A1 | 7/2008 | Johnson | |
| 2010/0051294 | A1 | 3/2010 | Nutley et al. | |
| 2011/0203793 | A1 | 8/2011 | Tibbles | |

* cited by examiner

DOWNHOLE ISOLATION METHODS AND APPARATUS THEREFOR

BACKGROUND ART

In the field of oil and gas exploration and production, it is common for sand and other fine solid particles to be present in reservoir fluids. These particles are highly abrasive and cause damage to the well and its components, and therefore in many formations, it is necessary for the wellbore completion to control the quantity of sand and other fine particles that enters the production tubing and is brought to surface with the production fluid. A wide range of sand control technologies are used in the industry, and typically comprise a system of sand control devices (such as sand screens) displaced along the completion string which filter sands and fine particles from the reservoir fluids and prevent them from entering the production tubing.

Sand control devices are typically used in conjunction with one or more gravel packs, which comprise gravel or other particulate matter placed around the sand control device to improve filtration and to provide additional support to the formation. In a gravel pack operation, a slurry of gravel solids in a carrier fluid is pumped from surface along the annulus between the sand control device and the open or cased hole, and a successful gravel pack requires a good distribution of gravel in the annulus at the sand control device.

In many subterranean formations, a well will pass through be multiple hydrocarbon bearing zones which are of interest to the operator, and it is necessary to gravel pack the individual zones. An example of a multi-zone completion system is shown in FIG. 1. The system, generally shown at 100, includes a production facility at surface, which in this case is a floating production storage and offloading (FPSO) vessel 102, coupled to a well 104 via subsea tree 106. The wellbore in this case is an inclined wellbore which extends through multiple production intervals 107*a*, 107*b*, 107*c* in the formation 108. The production tubing 110 provides a continuous flow path which penetrates through the multiple zones. The production tubing is provided with ports or inflow control devices (not shown) which allow production fluid to flow into the production tubing and out to the subsea tree 106. In order to provide control over the production process, the annulus 112 is sealed by packers 114 between the different production zones 107 to prevent fluid flowing in the annulus between the different zones. Sand control devices 116 prevent solid particles from the gravel pack and the formation entering the production tubing.

In a conventional approach to sand control, a gravel pack is installed across the first isolated zone 107*c* by running gravel pack tools in a dedicated gravel pack operation. Subsequently, in a separate gravel pack operation, a gravel pack is installed across an adjacent isolated zone 107*b*. The procedure can be performed multiple times to place gravel packs across all zones of interest. In some formations, where adjacent zones are particularly close together, it may not be possible to perform separate gravel pack operations. Even where it is possible to perform separate gravel pack operations, it is desirable to install gravel packs across all zones of interest in a single trip when multiple production zones are in close proximity to one another. Such tool systems and methods are referred to as single trip multi-zone systems. In these methods, the gravel pack slurry is pumped with the gravel pack tools positioned across each of the intended zones and the gravel is placed across multiple zones in a single trip, but with distinct and separate pumping operations for each zone. These single trip multi-zone systems reduce the overall time of the gravel pack operation significantly but do suffer from some major disadvantages. For example, the operations are complicated and require a lot of specialized equipment to be installed into the wells; service tools must be repositioned for gravel packing each zone; and pumping must be stopped upon the completion of one zone, and restarted when the tools have been positioned at the next.

To improve the delivery of gravel slurries, sand control devices have been provided with shunt tubes, which create alternate flow paths for the gravel and its carrier fluid. These alternate flow paths significantly improve the distribution of gravel in the production interval, for example by allowing the carrier fluid and gravel to be delivered through sand bridges that may be formed in the annulus before the gravel pack has been completed. Examples of shunt tube arrangements can be found in U.S. Pat. No. 4,945,991 and U.S. Pat. No. 5,113,935. The shunt tubes may also be internal to the filter media, as described in U.S. Pat. No. 5,515,915 and U.S. Pat. No. 6,227,303.

U.S. Pat. No. 6,298,916 describes a multi-zone packer system which comprises an arrangement of cup packers with shunt tubes used in a gravel pack operation. An upper packer is bypassed by a crossover device to deliver the gravel pack slurry to a first production zone, and the shunt tubes allow the slurry to be placed at the subsequent zones beneath the zonal isolation packers. U.S. Pat. No. 7,562,709 describes an alternative method in which the zonal isolation is achieved by the use of swellable packers, which include a mantle of swellable elastomeric material formed around a tubular body. Shunt tubes run underneath the swellable mantle to allow the gravel pack slurry to bypass the isolation packers.

It is also proposed in WO 2007/092082 and WO 2007/092083 to provide packers with alternate path mechanisms which may be used to provide zonal isolation between gravel packs in a well, and embodiments described in WO 2007/092082 and WO 2007/092083 include packers with swellable mantles which increase in volume on exposure to a triggering fluid. US 2010/0155064 and US 2010/0236779 also disclose the use of swellable isolation devices in shunt tube gravel packing operations.

Although the above-described shunt tube systems allow zonal isolation in gravel pack operations, the reliance on shunt tubes as a bypass mechanism for gravel slurry placement is undesirable. Reliance on shunt tubes adds to the general complexity of the completion and installation operation. For example, shunt tubes must be aligned and made up to jumper tubes of adjacent sand control devices when the production tubing is assembled.

The use of shunt tubes may also cause complications for maintaining the required annular barrier or fluid seal functions of the isolation packers, as they are required to be actuated to expand around shunt tubes. In swellable elastomer systems, problems may arise due to removal of a volume of elastomer from the isolation device, improper sealing around the shunt tubes, displacement of the conduits due to expansion of the element, and/or coupling of the conduits at opposing ends of the isolation device. Accommodation of shunt tubes may necessitate a reduction in the overall volume of the expanding element, and in particular a reduction in the volume of the expanding element which is radially outward of the shunt tube. A shunt tube system with swellable isolation may therefore take longer than desirable to achieve a seal and/or may not have sufficient pressure sealing performance. Mitigating these problems may require the run-in diameter of the swellable packer to be increased, which can impact on the success of deployment operations, or reduction in the effective production bore size, which is detrimental to production rates.

While the use of swellable elastomer packers and isolation devices have several advantages over conventional packers including passive actuation, simplicity of construction, and robustness in long term isolation applications, their use in conventional gravel pack applications described above may increase the time taken to perform the entire gravel pack operation. This is because in a conventional approach, the isolation devices are set against the wall of the open or cased hole to isolate the zones prior to placement of the gravel pack. This sequence means that the gravel pack cannot be placed until the swellable isolation device has swollen, which in many cases may be a number of days. This introduces a delay before pumping of the gravel slurry which may be undesirable to the operator.

SUMMARY OF INVENTION

It is amongst the aims and objects of the invention to provide a method and/or apparatus for installing multiple interval gravel pack operations and which addresses one or more deficiencies of previously proposed methods and apparatus. It is another aim and object of the invention to provide a downhole isolation apparatus and method which does not rely on the use of shunt tubes through the apparatus. It is further aim and object of the invention to provide an improved method of gravel packing a wellbore. Other aims and objects of the invention will become apparent from the following description.

According to a first aspect of the invention, there is provided a method for use in a wellbore, the method comprising:

providing an apparatus in a downhole annulus in a wellbore, the apparatus comprising a mandrel and a swellable element disposed on the mandrel, wherein the swellable element comprises a material selected to increase in volume when exposed to a downhole stimulus;

placing a gravel pack below the apparatus via the downhole annulus in which the apparatus is located;

placing a gravel pack above the apparatus;

subsequent to placing the gravel packs, causing the swellable element to increase in volume to create an annular barrier in the wellbore.

In the context of this description, the word 'mandrel' is used to designate a body on which a swellable member may be located, and should be interpreted broadly to include tubulars, pipes, and solid bodies, whether or not they are cylindrical or have alternative cross-sectional profiles. Unless the context requires otherwise, it is interchangeable with the term 'tubular' or 'tubing' or "base pipe' without limitation. The words "upper", "lower", "downward" and "upward" are relative terms used herein to indicate directions in a wellbore, with "upper" and equivalents referring to the direction along the wellbore towards the surface, and "lower" and equivalents referring to the direction towards the bottom hole. It will be appreciated that the invention has application to deviated and lateral wellbores. The term 'annular barrier' should be interpreted generally to mean a device or component which substantially impedes or restricts flow in an annular space, including but not limited to devices which create a fluid seal and which are capable of full isolation and resistance to substantial pressure differentials.

Preferably the method comprises placing a gravel pack below the apparatus via and placing a gravel pack above the apparatus in a single gravel pack operation.

Preferably, the annular barrier is an annular seal, and the method may therefore comprise providing isolation between a portion of the wellbore annulus located above the apparatus and a portion of the wellbore annulus located below the apparatus. More preferably, the apparatus is provided at a downhole location between two hydrocarbon production intervals or intervals that will be used for the injection of fluids or gas. Therefore the invention may comprise causing the swellable element to swell to provide isolation in the downhole annulus (for example to isolate one production zone from an adjacent production zone). The swellable member may be swollen into contact with a surrounding wellbore wall, which may be an openhole or a cased hole.

Preferably, the method comprises displacing gravel pack solids into one or more voids, and causing the swellable element to swell into a space vacated by the displaced gravel pack solids.

Preferably, the method comprises forming one or more voids in or adjacent the downhole annulus between the swellable element and a surrounding surface; causing the swellable element to swell in the annulus; and displacing solid material of the gravel pack into the one or more voids.

Preferably forming the one or more voids is performed at the same time as swelling of the swellable element. Therefore the solid material of the gravel pack may be displaced as the swellable element swells and the void is created.

By forming a void to accommodate the sand or gravel (or other solid materials) from the gravel pack, space is provided which allows the swellable member to swell in the annulus. Sand or gravel which may otherwise prevent swelling is displaced into the void. This allows the use of swellable materials, such as swellable elastomers, which have relative modest swelling forces compared to expansion forces possible with mechanical or hydraulic tools. In the context of this invention, the term elastomer is used to designate a material with elastomeric properties, including synthetic and naturally occurring rubbers.

The one or more voids may be formed in a volume between the mandrel and a surrounding wellbore wall.

In some embodiments of the invention, the one or more voids are formed in a volume of gravel pack material.

The gravel pack material may for example comprise a mixture of solid particles and sacrificial particles or proppants, which may be interspersed in a gravel pack slurry. Thus the gravel slurry may comprise a transport fluid containing a mixture of solid particles (such as sand and gravel) and sacrificial particles. The sacrificial particles may comprise a material or structure which is designed to degrade or change in volume in wellbore conditions; this degradation or change in volume may therefore form voids in the gravel pack material, into which the solid particles of the gravel pack material may be displaced by the swelling action of swellable member.

Preferably, the proportion of sacrificial particles in the gravel pack slurry is selected to provide a sacrificial volume approximately equal to the volume of solid material required to be displaced by the swellable member during swelling.

The sacrificial particles may comprise a material which undergoes changes in its shape (and volume) in wellbore conditions. For example, the sacrificial particles may comprise a solid material, such as a foamed plastic or elastomer, which is compressible or compliant at wellbore temperatures and/or pressures. Swelling forces of the swellable member may then cause the sacrificial particles to reduce in volume and create voids in the gravel pack material.

The sacrificial particles may comprise a solid material which for example is a plastic or elastomer, which is compressible or compliant at wellbore temperatures and/or pressures. Swelling forces of the swellable member may then cause the sacrificial particles to reduce in volume and create voids in the gravel pack material.

The sacrificial particles may comprise a material which undergoes changes in its mechanical properties in wellbore conditions. For example, the sacrificial particles may comprise a solid material which at wellbore temperatures and/or pressures, becomes more compressible or compliant than it was during a surface or run-in condition.

The sacrificial particles may comprise a solid material which changes phase in wellbore conditions. For example, the sacrificial particles may comprise a gel which, at wellbore temperatures and/or pressures, forms a liquid. The liquid may then flow out of the gravel pack volume to leave one or more voids. The sacrificial particles may comprise one or more of the following:

a. Beads formed from a substance which sublimates, such as naphthalene or 1,4-dichlorobenzene.

b. An encapsulated dissolvable system comprising a relatively stable outer shell and a liquid or other dispersible material. Suitable materials for the outer shell include animal proteins such as gelatine, or plant polysaccharides or their derivatives such as carrageenans and modified forms of starch and cellulose. The shell is dissolved in use to allow the inner material to disperse.

c. Hard wax beads or pellets, which are broken down by solvents (such as light hydrocarbons) or crystal modifiers.

d. A hardened pellet of a hydrocarbon gel or wax, or polymeric material which is solid at room temperature and melts at wellbore temperatures.

e. A combination of a swellable rubber blended with high concentrations of super absorbent polymers (SAPs) or hydrogels. Exposure of the swellable rubber matrix to a triggering fluid causes the matrix to swell and reduces its ability to bind the SAPs or hydrogels in the mixture, allowing them to disperse.

f. Xanthan gels or hydroxyl gels.

g. Industry standard gel and breaker systems.

h. Temporary plugging agents such as benzoic acid and its salts (e.g. sodium benzoate) which are dissolvable in the wellbore.

i. Slow dissolving crystals (for example large crystals of salt).

The method may comprise changing a volume that the apparatus occupies in the downhole annulus to form one or more voids. In one embodiment, a contracting portion of the apparatus is caused to decrease in volume to create one or more voids.

In another embodiment, the method comprises exposing a cavity in the apparatus into which gravel pack solids may be displaced.

An alternative embodiment comprises the step of diverting the flow of a gravel pack slurry to preferentially place the gravel pack and restrict the volume of gravel pack solids placed adjacent the swellable element. Preferably, the method comprises preventing the passage of gravel pack solids into a portion of the annulus when flow of the gravel pack slurry has ceased in an area of the well as a result of covering lower screens with gravel or sand. The method may comprise pumping gravel pack slurry through a convoluted path, and may further comprise causing gravel pack solids to settle on a surface above the portion of the annulus.

According to a second aspect of the invention, there is provided a swellable downhole apparatus comprising:

a mandrel;

a swellable element on the body, the swellable element comprising a material selected to increase in volume when exposed to a downhole stimulus and arranged on the body to swell in a wellbore annulus to provide an annular barrier between the body and a surrounding wall in the wellbore;

wherein in use, the apparatus comprises a void for accommodating a volume of solid material displaced from the wellbore annulus by the swellable member when it swells to a swollen condition.

The apparatus may comprise a first condition in which the apparatus defines a first volume in the wellbore annulus, and a second condition in which the apparatus comprises the void. The apparatus may comprise a contracting portion which decreases the volume that the apparatus occupies in the wellbore annulus to form one or more voids. In another embodiment, the apparatus comprises a cavity into which gravel pack solids may be displaced.

The contracting portion may comprise one or more sacrificial materials, selected to undergo a physical change in the wellbore annulus to decrease the volume that the apparatus occupies in the wellbore annulus. At least one of the one or more sacrificial materials may be selected to undergo a physical change in wellbore conditions to allow it to be dispersed in the gravel pack solids.

The contracting portion may comprise any of the materials listed above in the context of the first aspect of the invention, which may be modified to allow it to be arranged into a volume carried by the tool to the downhole location. For example, the sacrificial portion may comprise particles, beads, capsules or pellets compressed or compacted to form a solid tool body, or may comprise a mesh or matrix which binds the material into a solid tool body. In one configuration, the sacrificial material comprises a matrix of elastomeric material which swells to permit fluid access to and/or migration of discrete particles, beads, capsules or pellets to accelerate dispersal of material into the gravel pack material.

The apparatus may comprise a plurality of contracting portions, and may comprise a plurality of swellable elements. The apparatus may comprise a plurality of contracting portions and a plurality of swellable elements arranged alternately on the mandrel.

The apparatus may comprise one or more expanding portions and one or contracting portions, wherein the one or more contracting portions is formed from a relatively soft material (i.e. softer than the expanding portions). The apparatus may comprise one or more relatively hardened formations on or around the expanding portions. The hardened formations may comprise tips, points and/or rings, which may be metal, composite, plastic or relatively hard elastomeric material, and may provide multiple initial point contacts or a circumferential line contact.

Preferably the contracting portions are formed from an elastomer which substantially does not swell, or has a lower swelling rate, than the material forming the expanding portions.

The apparatus may comprise a contracting portion which defines an internal chamber. The chamber may be configured to change shape by collapse, contraction, or other deformation of the contracting volume to decrease the volume occupied in the wellbore.

The chamber may comprise a fluid port for draining a fluid from the chamber. The fluid port may comprise fluid plugs, which may operable to be opened, for example by shearing. The fluid ports may comprise valves for controlling the evacuation of a fluid from the chamber.

In one embodiment the chamber comprises a selective permeability membrane, which may be selected to contain a material within the chamber in a first condition, and permit the passage of the material out of chamber and through the selective permeability membrane in a second condition.

The apparatus may comprise a chamber and a means for delivering a fluid from the chamber to a swellable element. The fluid may be a triggering fluid for the swellable element, and therefore the apparatus may be configured to drain the fluid chamber and deliver fluid to the swellable element. The means may comprise a fluid communication channel, which may be a porous or fibrous wicking material. The fluid communication channel may extend from the fluid chamber 386 into the swellable element.

The apparatus may comprise a chamber and a fluid control line running to surface. The fluid control line may permit controlled evacuation of a fluid from the chamber.

The apparatus may comprise a contracting portion comprising a mechanical reinforcement or support structure. The contracting portion may comprise a layer of material selected to degrade or disperse in wellbore conditions to expose an internal void. The void may be located within the mechanical support structure, which may comprise openings for the passage of solids from a gravel pack into the void.

In one embodiment of the invention, the apparatus comprises a contracting portion comprising a chamber which is in fluid communication with a wellbore annulus in use. The fluid communication is preferably via one or more valves, which may be one-way valves. The valves may be configured to permit in-flow of fluid from the wellbore annulus to the chamber during run in and/or placement of a gravel pack. The apparatus may be provided with one or more fluid outlets which permit fluid to be evacuated from the chamber and allow it to decrease in volume. In one embodiment, the valves have a first condition in which they permit in-flow from the wellbore annulus to the chamber and prevent out-flow of fluid from the chamber; and a second condition in which they permit flow into and out of the chamber. The function of the fluid outlets may therefore be fulfilled by the valves in their second condition.

The apparatus may comprise a swellable element configured to swell progressively from a first longitudinal position to a second longitudinal position. Preferably, the first longitudinal position is located further away from a corresponding contracting portion than the second longitudinal position. The swellable element may therefore swell progressively in a direction towards the contracting portion. The first longitudinal position may be located above (or closer to surface) than the second longitudinal position.

In some embodiments of the invention, the apparatus comprises a void or concealed volume for accommodating solids from the gravel pack. The void or concealed volume may be located in the mandrel or base pipe. The apparatus may comprise one or more members movable from a first position in which an opening the void or concealed volume is covered, to a second position in which the opening is not covered.

The apparatus may comprise a device for preventing or restricting solid particles of a gravel pack passing through the annulus. Preferably, the device (which may be referred to as a solids barrier), permits passage of solids therethrough with the flow of a carrier fluid, but prevents or restricts solid particles from the gravel pack passing through the annulus in the absence of flow of the carrier fluid.

Embodiments of the second aspect of the invention may comprise features of the first aspect of the invention and its embodiments or vice versa.

According to a third aspect of the invention, there is provided a gravel pack mixture comprising a plurality of solid particles and a plurality of sacrificial particles mixed among the solid particles, wherein the sacrificial particles are formed from a material selected to a occupy a first volume in a gravel pack slurry during pumping and placement around a downhole completion, and the material is selected to undergo a physical change in wellbore conditions to decrease the effective volume of the gravel pack.

Preferably, the material is selected to undergo a physical change in wellbore conditions to allow it to be dispersed in the gravel pack solids and reduce be dispersed in the gravel pack solids.

Embodiments of the third aspect of the invention may comprise features of the first or second aspects of the invention and their embodiments or vice versa.

According to a fourth aspect of the invention, there is provided a method of performing a gravel pack operation in a wellbore, the method comprising:

providing an apparatus in a downhole annulus in a wellbore, the apparatus comprising a mandrel and a swellable element disposed on the mandrel, wherein the swellable element comprises a material selected to increase in volume when exposed to a downhole stimulus;

placing a gravel pack in the downhole annulus in which the apparatus is located;

forming one or more voids in or adjacent annulus;

causing the swellable element to increase in volume in the downhole annulus; and displacing solid material of the gravel pack into the one or more voids.

Preferably forming the one or more voids is performed at the same time as swelling of the swellable element. Therefore the solid material of the gravel pack may be displaced as the swellable element swells and the void is created.

The one or more voids may be formed in a volume between the mandrel and a surrounding wellbore wall.

In some embodiments of the invention, the one or more voids are formed in a volume of gravel pack material.

The gravel pack material may for example comprise a mixture of solid particles and sacrificial particles or proppants, which may be interspersed in a gravel pack slurry.

Embodiments of the fourth aspect of the invention may comprise features of the first to third aspects of the invention and their embodiments or vice versa.

According to a fifth aspect of the invention, there is provided a method of performing a gravel pack operation in a wellbore, the method comprising:

providing an apparatus in a downhole annulus in a wellbore, the apparatus comprising a mandrel and a swellable element disposed on the mandrel, wherein the swellable element comprises a material selected to increase in volume when exposed to a downhole stimulus;

providing an upper solids barrier above the swellable element;

pumping a gravel pack carrier fluid in the downhole annulus in which the apparatus is located, through the upper solids barrier and past the apparatus, to transport gravel pack solids through the upper solids barrier and place a gravel pack over one or more sand control devices located below the apparatus;

reducing flow through the upper solids barrier to substantially prevent the transport of gravel pack solids through the upper solids barrier;

causing the swellable element to increase in volume to form an annular barrier in the downhole annulus.

Preferably, the method comprises, subsequent to placing a gravel pack over one or more sand control devices located below the apparatus, placing a gravel pack over one or more sand control devices located above the apparatus. Preferably, the gravel pack is placed over the one or more sand control devices located above the apparatus in a continuation of the placement of the gravel pack over one or more sand control devices located below the apparatus (i.e. as part of the same pumping operation). The method may therefore comprise diverting the gravel pack carrier fluid from a first flow path, in which it causes gravel pack solids to be placed over one or more sand control devices located below the apparatus, to a second flow path in which it causes gravel pack solids to be placed over one or more sand control devices located above the apparatus. In the second flow path, the flow of the carrier fluid through the upper solids barrier is preferably insufficient to transport gravel pack solids past the upper solids barrier. Preferably, in the second flow path, the flow of the carrier fluid through the upper solids barrier is substantially or completely ceased.

Preferably, the method comprises allowing gravel pack solids to settle on the upper solids barrier.

Embodiments of the fifth aspect of the invention may comprise features of the first to fourth aspects of the invention and their embodiments or vice versa.

According to a sixth aspect of the invention, there is provided an apparatus for use in a gravel pack operation in a wellbore comprising:

a tubing configured to be located in a wellbore to define a wellbore annulus;

an expanding element arranged on the tubing to expand and form an annular barrier in the wellbore annulus;

and an upper solids barrier located above the expanding element;

wherein the upper solids barrier is configured to permit the passage of gravel pack solids when a gravel pack carrier fluid is pumped through the upper solids barrier, and is configured to restrict or prevent the passage of gravel pack solids when there is a reduced flow of carrier fluid through the upper solids barrier.

Preferably, the upper solids barrier comprises a convoluted path for fluid and/or solids pumped through the upper solids barrier. The upper solids barrier may comprise a surface for supporting gravel pack solids.

The apparatus may comprise a lower solids barrier.

Embodiments of the sixth aspect of the invention may comprise features of the first to fifth aspects of the invention and their embodiments or vice versa.

BRIEF DESCRIPTION OF DRAWINGS

There will now be described, by way of example only, various embodiments of the invention with reference to the drawings, of which.

DESCRIPTION OF EMBODIMENTS

As used herein, the term "a computer system" can refer to a single computer or a plurality of computers working together to perform the function described as being performed on or by a computer system.

Figure 1:
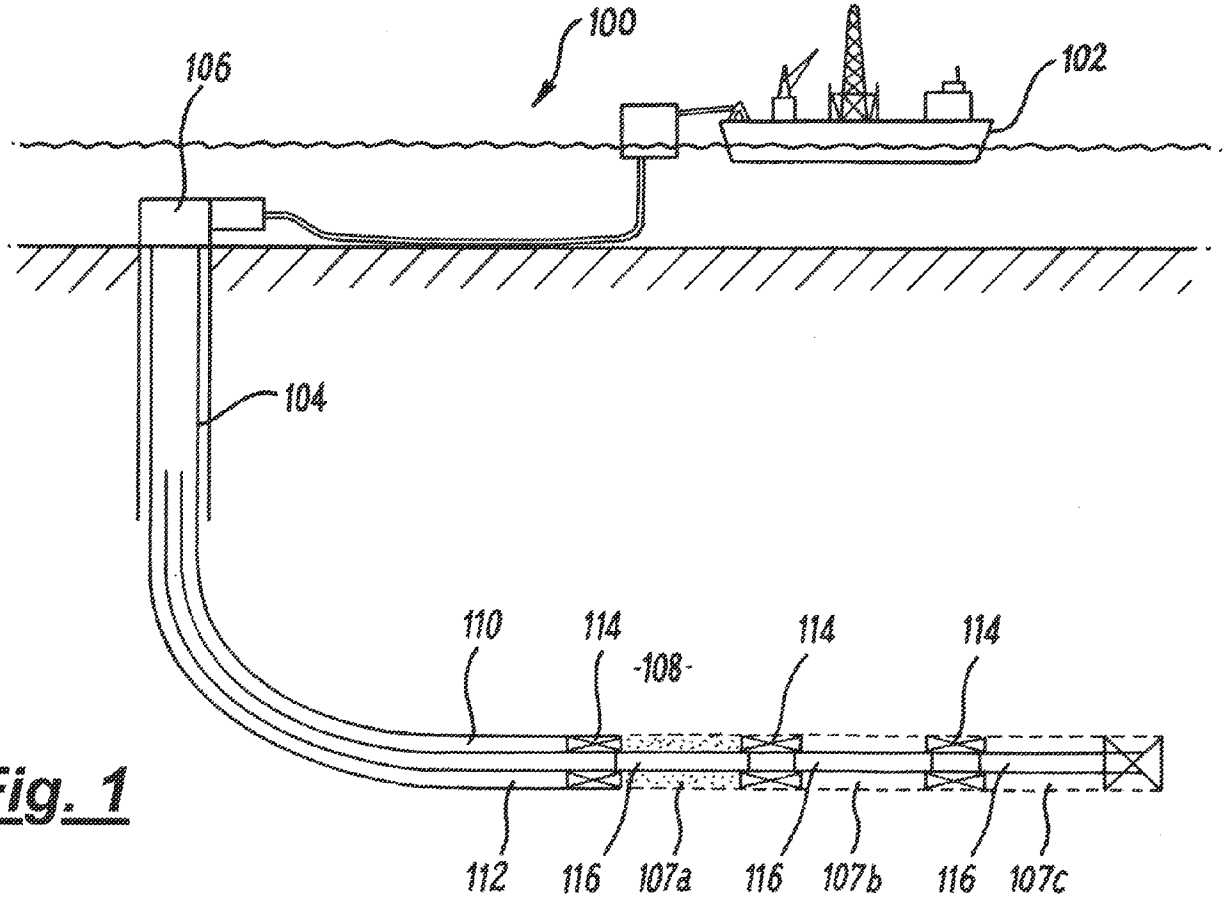
FIG. 1 is a schematic sectional view of a multi-zone production system according to the prior art.

As described above, FIG. 1 is a multi-zone production system according to the prior art, in which gravel pack installation is performed in individual zones in separate gravel pack operations. Embodiments of the invention are examples of alternative approaches to gravel pack installation, as will be apparent from the following detailed description.

Figure 2A:
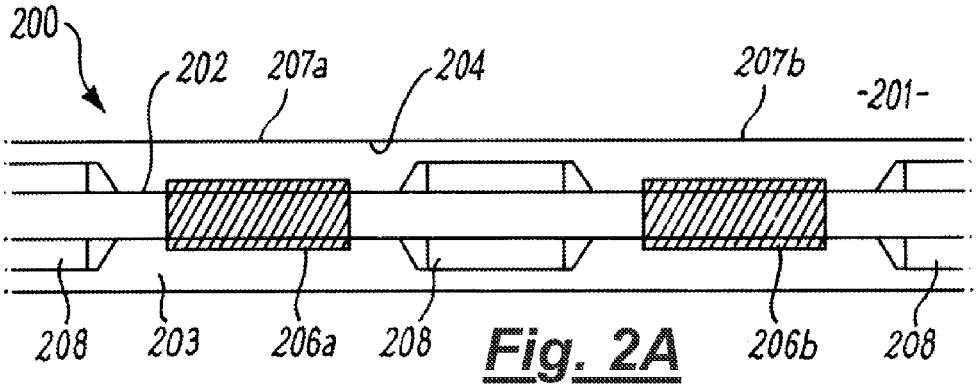
FIG. 2A is a schematic sectional view through a multi-zone completion according an embodiment of the invention, with a gravel pack placed across multiple production intervals.
Figure 2B:
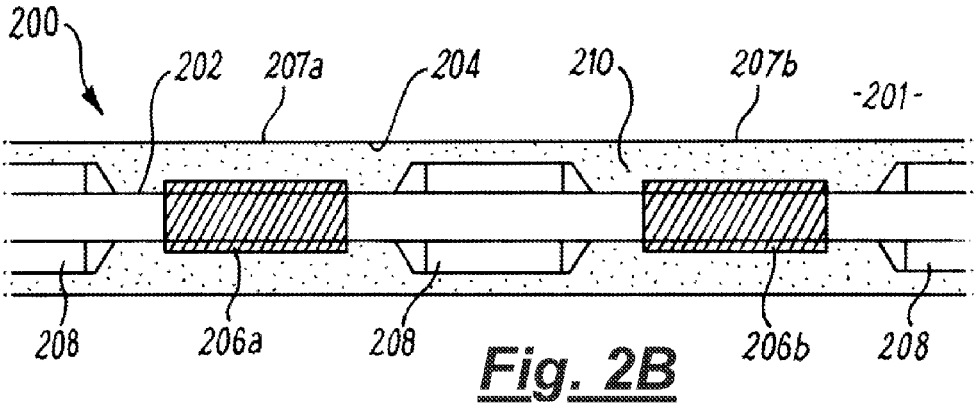
FIG. 2B is a schematic sectional view through the multi-zone completion of FIG. 2A in a zonal isolation condition.
Figure 2C:
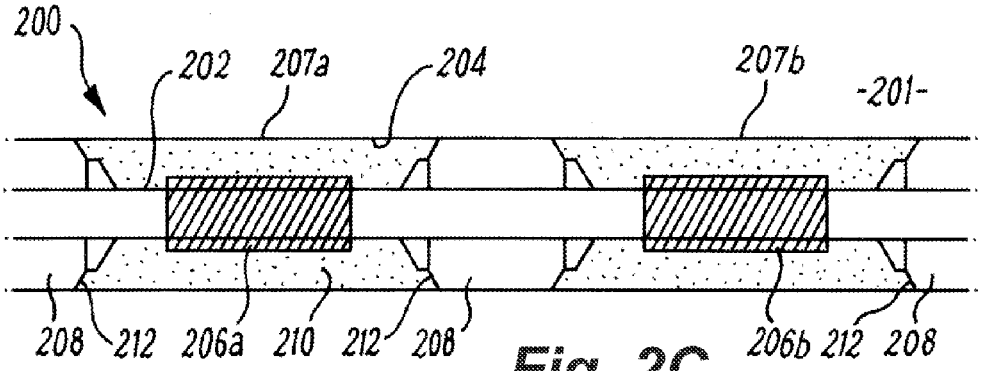
FIG. 2C is a schematic sectional view through the multi-zone completion of FIGS. 2A-2B after formation of an annular barrier.

Referring to FIGS. 2A to 2C, a longitudinal section of a part of completion system 200 in a subterranean formation 201 is shown in two different phases of installation. FIG. 2A shows a production tubing 202 located in a wellbore 204 (which in this example is a cased hole). Located on the production tubing 202 at axially separated locations are sand control devices 206*a* and 206*b* (together referred to as 206). The sand control devices 206*a*, 206*b* are respectively located in production intervals (or zones) 207*a*, 207*b*. Isolation devices in the form of swellable wellbore packers 208 are located between the sand control devices 206.

With the production tubing 202 and its components run in hole to the correct position as shown in FIG. 2A, a gravel pack 210 is placed at the production intervals 207*a*, 207*b* by pumping a gravel slurry in the annulus 203 between the production tubing 202 and the wellbore wall. The gravel pack 210 is placed across the intervals 207*a* and 207*b* to surround the sand control devices 206 in a single step by pumping the slurry past the swellable wellbore packers 208 before they are in an expanded condition. FIG. 2B shows the gravel pack 210 in position across multiple intervals 207.

In the methods of the present invention, the zones 207 are isolated from one another by expansion of the isolation devices subsequent to placement of the gravel pack 210. With the gravel pack 210 in place, the swellable wellbore packers 208 are exposed to a triggering stimulus in a conventional manner to cause them to increase in volume. For example, the swellable wellbore packer comprises a swellable elastomeric material selected to increase in volume on exposure to a liquid hydrocarbon. The increase in volume forms an annular barrier 212 between the gravel packed production intervals 207*a* and 207*b* which resists (or completely prevents) flow of fluids in the annulus 203 between zones 207, as illustrated in FIG. 2C.

By isolating the production zones after gravel pack placement, the present invention simplifies the gravel pack installation operation significantly; allows gravel packs to be installed across zones which are close proximity; and avoids gravel packing multiple intervals as separate operations while allowing the operator to produce from or inject into the different zones separately and independently with annular isolation and/or resistance to differential pressures. It is advantageous that the present invention does not rely on the use of shunt tube alternate path systems and allows the use of concentric bypass flow paths for the gravel pack slurry.

The inventors have recognised that the effectiveness of the isolation or annular barrier is dependent on the extent to which the isolation device is able to swell into the annular space in which the gravel pack has been placed, and the inventors have recognised that in some production/completion systems, the degree of isolation may be limited by the swell forces of the swellable wellbore packer. Specific embodiments of the invention as exemplified below facilitate swelling (and therefore isolation) by providing methods or apparatus for displacing or rearranging solid material in the gravel pack after it has been placed.

Figure 3A:
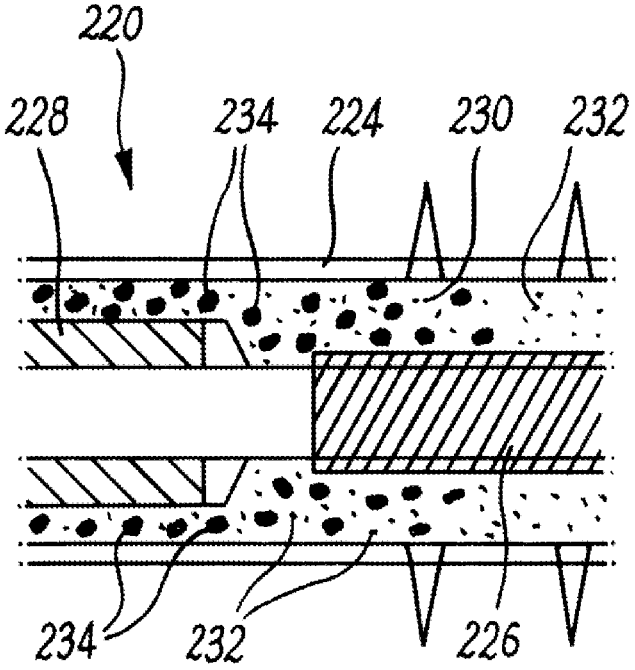
FIGS. 3A and 3B are schematic sectional views of a packer system according to an embodiment of the invention, respectively before and after the formation of an annular barrier.
Figure 3B:
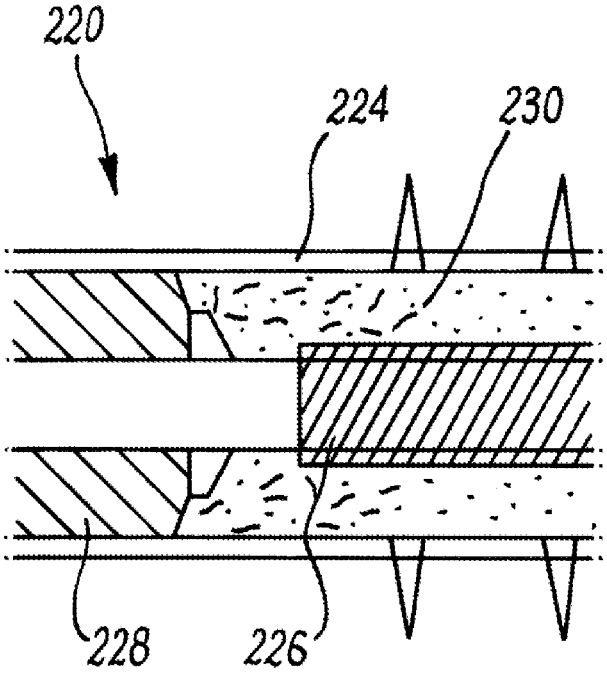

FIGS. 3A and 3B show schematically a sectional view of a part of a multi-zone production system 220 comprising a production tubing 222 in a cased well 224, a sand control device 226 and an isolation device in the form of a swellable wellbore packer 228. A gravel pack 230 is placed in the annulus in the manner described with reference to FIGS. 2A to 2C. The gravel pack 230 contains a mixture of solid particles 232 such as sand and gravel and sacrificial particles in the form of beads 234. The beads 234 are in this embodiment particles formed from a solid gel-like material and are mixed with the solid gravel pack particles in pre-calculated proportions. The beads 234 cumulatively take up a known volume V of the gravel pack 230. The solid gel-like material of the beads 234 is selected to retain its state and volume in the gravel pack 230 during pumping of the slurry in the annular space, and therefore takes up a volume V in the gravel pack 230 around the packer 228, as shown in FIG. 3A. However, the material of the beads 234 is selected to undergo a change in wellbore conditions. After a period of time in wellbore conditions the gel-like material of the bead softens and liquefies and disperses into the gravel pack 230. This gel like material is dispersed into the interstices between solid gravel pack particles which causes a change in the total space that the gravel pack occupies around the swellable packer 228. The liquefying of the beads 234 creates a number of voids in the annular space into which the solid particles 232 of the gravel pack are displaced as the swellable packer 228 increases in volume. The expansion volume required to create a suitable annular barrier in the production system can be pre-calculated, and the proportion of beads 234 can be selected such that the volume V is equal to or approximately equal to the expansion volume. Therefore the solid particles in the annular space between the packer 228 and the wellbore wall are displaced into voids created around the packer 228 and allow the swellable material of the packer to increase in volume. This method therefore provides an effective technique for gravel pack displacement to facilitate forming an annular barrier in a single trip multi-zone gravel pack operation.

It will be appreciated that where multiple wellbore packers are provided (as will usually be the case) the proportion of beads 234 is calculated to be equal or approximately equal to the cumulative expansion volume of the wellbore packers. It is desirable for the gravel pack material which is placed around and immediately adjacent the swellable wellbore packers to contain a greater density of sacrificial particles than the gravel pack material which is further away from the packers. This concentrates the volume change and displacement of the solid particles in the vicinity of the packer Alternative embodiments may comprise sacrificial particles of different materials and/or forms. In one alternative embodiment (not shown), the gravel pack 230 contains a mixture of solid particles 232 and balls of a foamed elastomeric material. The balls retain their shape and volume during pumping of the slurry in the annular space, and therefore take up a volume V in the gravel pack 230 around the packer 228. After a period of time under wellbore conditions, the foam material of the balls becomes compressible, and is compressed by the force of the solid particles of the gravel pack as the swellable packer increases in volume. The cumulative decrease in volume of the balls $\Delta V$ can be made equal to or approximately equal to the required expansion volume of the wellbore packers, to allow an equivalent volume of solid particles to be displaced from the vicinity of the packers to facilitate effective expansion. In another alternative embodiment the sacrificial particles comprise membranes or shells surrounding a solid core. Under surface and pumping conditions the membrane or shell is impermeable to the material of the core. However, after a period of time under wellbore conditions, the solid core liquefies to become permeable to the membrane or shell, and passes out of the membrane to be dispersed in the gravel pack. The resulting reduction in volume creates voids into which the solid particles around and adjacent the packer can be displaced.

In a further alternative embodiment, the mechanism by which the sacrificial material changes its state or volume is triggered by a controlled stimulus, such as delivery, injection or circulation of a fluid which changes the materials properties. For example, a chemical breaker might be delivered or circulated through the annular space to change a solid gel-like material to a liquid; or a solvent might be delivered or circulated to dissolve a solid material, or a membrane or shell which retains another material which is then dispersed into the gravel pack.

Other examples of materials which may be used in the present invention include the following (alone or in combination):

a. Beads formed from a substance which sublimates, such as naphthalene or 1,4-dichlorobenzene.

b. An encapsulated dissolvable system comprising a relatively stable outer shell and a liquid or other dispersible material. Suitable materials for the outer shell include animal proteins such as gelatine, or plant polysaccharides or their derivatives such as carrageenans and modified forms of starch and cellulose. The shell is dissolved in use to allow the inner material to disperse.

c. Hard wax beads or pellets, which are broken down by solvents (such as light hydrocarbons) or crystal modifiers.

d. A hardened pellet of a hydrocarbon gel or wax, or polymeric material which is solid at room temperature and melts at wellbore temperatures.

e. A combination of a swellable rubber blended with high concentrations of super absorbent polymers (SAPs) or hydrogels. Exposure of the swellable rubber matrix to a triggering fluid causes the matrix to swell and reduces its ability to bind the SAPs or hydrogels in the mixture, allowing them to disperse.

f. Xanthan gels or hydroxyl gels.

g. Industry standard gel and breaker systems.

h. Temporary plugging agents such as benzoic acid and its salts (e.g. sodium benzoate) which are dissolvable in the wellbore.

i. Slow dissolving crystals (for example large crystals of salt).

Figure 4A:
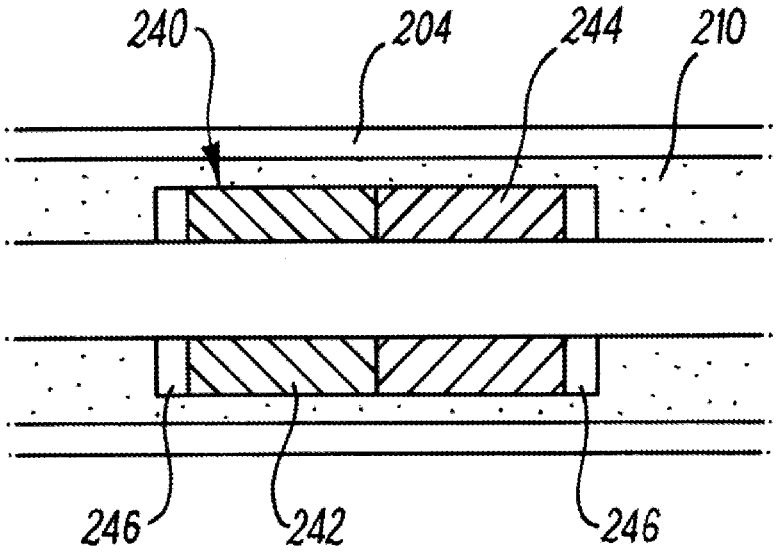
FIGS. 4A and 4B are schematic sectional views of a packer system according to an alternative embodiment of the invention, respectively before and after the formation of an annular barrier.
Figure 4B:
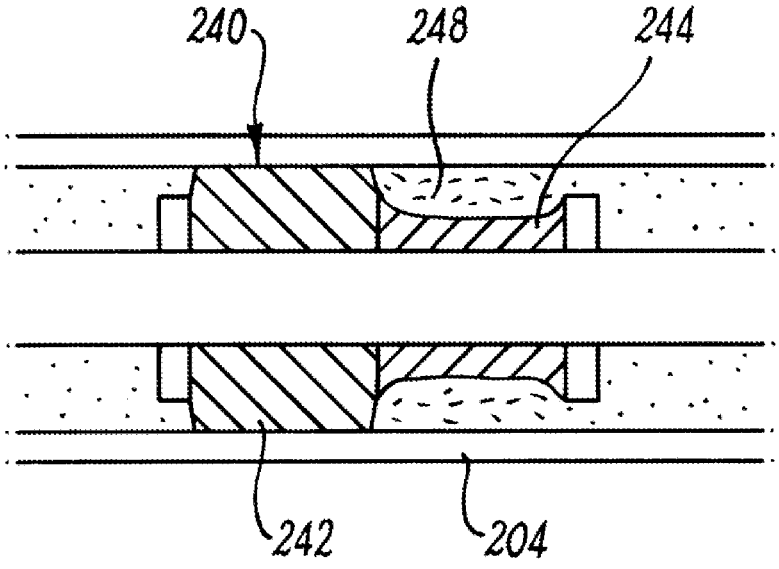

The embodiments described above use modifications to the gravel pack materials to provide a volume change in the gravel pack material or proppant—after its placement—to accommodate expansion of an isolation device. FIGS. 4A and 4B show schematically an embodiment of a swellable wellbore packer which provides similar benefits in gravel packing applications, but by adaptation of the tool itself. The swellable wellbore packer, shown generally at 240 in longitudinal section, is located on a production tubular in a wellbore 204. The swellable packer 240 comprises a material 242 selected to increase in volume on exposure to a wellbore fluid, and a sacrificial material 244 located between a pair of end rings 246. In this example, the sacrificial material is a thermoplastic polymer material. When the packer 240 is located correctly in the wellbore 204, a gravel pack 210 is placed around the packer 240. The sacrificial material 244 accommodates a volume in the annular space in the wellbore during placement of the gravel pack 210 (FIG. 4A). After a prolonged period at wellbore temperatures, the thermoplastic material 244 begins to soften and melt, turning to a liquid phase which is then dispersed amongst in the pores in the gravel pack. This causes a decrease in tool volume in the vicinity of the swellable packer, into which solid particles of the gravel pack are displaced as the swellable material increases in volume to form an annular barrier. The sacrificial material is selected according to the conditions that will be experienced during deployment and/or manufacture. For example, where the tool is to be used in high temperature wellbores, a sacrificial material will be chosen to have a melting point sufficiently high to prevent it from melting too quickly (i.e. before the swelling action of the expanding material). Similarly, if the manufacture of the tool comprises processing steps which subject the tool to high temperatures (e.g. curing of a swellable elastomer) the sacrificial material will be chosen so as not to melt during manufacture (or the manufacturing process will be modified to prevent exposure of the sacrificial material to the elevated temperatures).

It will be appreciated that other types of sacrificial materials may be used in alternative embodiments of the invention. For example, the embodiment of FIGS. 4A and 4B could include a sacrificial material selected to degrade or change volume under pressures experienced in the wellbore. Alternatively (or in addition) a sacrificial material may be selected to degrade on exposure to wellbore fluids which are present in the wellbore, or fluids which are delivered or circulated downhole. For example, the sacrificial material could comprise a material, such as a hard gel-like material, resin or plastic, which is sensitive to a solvent or chemical breaker. Delivery of a fluid containing the solvent or chemical breaker, for example by circulating a fluid past the tool, may causes the sacrificial material to be dissolved or otherwise dispersed to create a void into which the solid particles of the gravel pack material may be displaced. Any of the materials listed above in the context of the embodiment of FIG. 3A or 3B may be used, modified to allow it to be arranged into a volume carried by the tool to the downhole location. For example, the sacrificial portion may comprise particles, beads, capsules or pellets compressed or compacted to form a solid tool body, or may comprise a mesh or matrix which binds the material into a solid tool body. In one configuration, the sacrificial material comprises a matrix of elastomeric material which swells to permit fluid access to and/or migration of discrete particles, beads, capsules or pellets to accelerate dispersal of material into the gravel pack material.

Figure 5A:
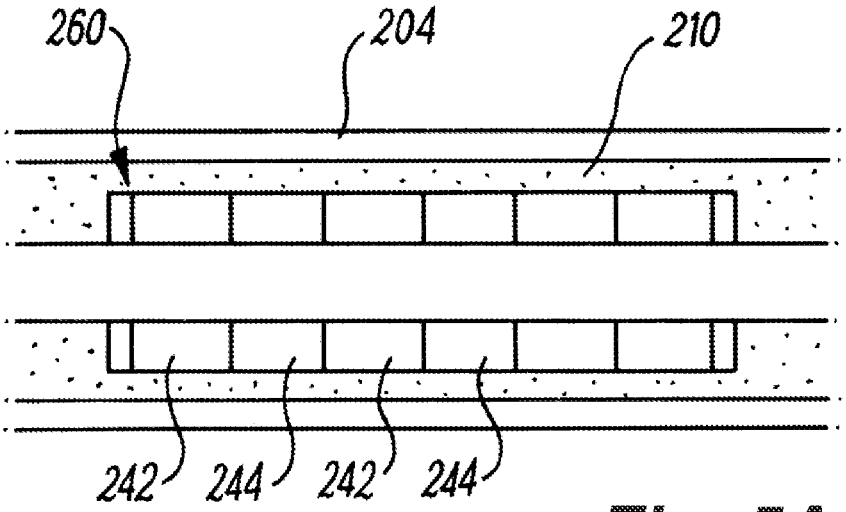
FIGS. 5A and 5B are schematic sectional views of a packer system in accordance with a further alternative embodiment of the invention, respectively before and after the formation of an annular barrier.
Figure 5B:
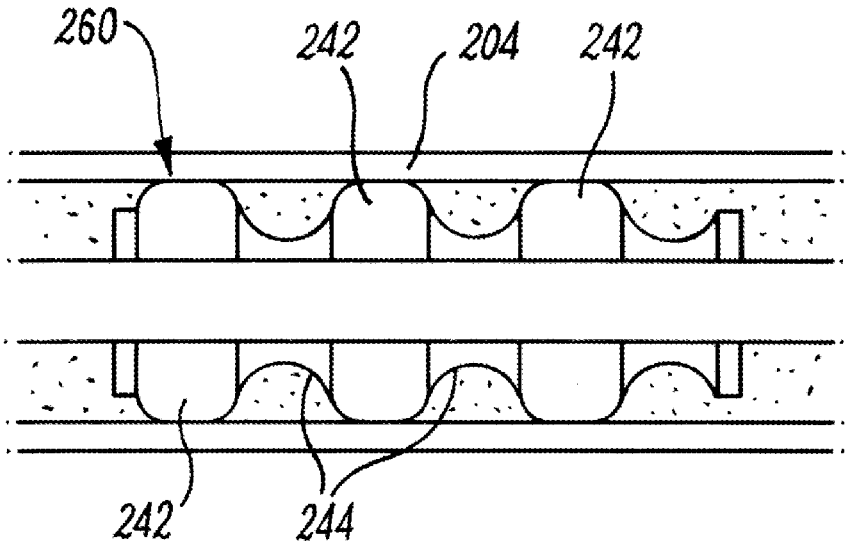

The principles of the embodiment of FIGS. 4A and 4B may also be applied to a multiple ring tool configuration, as shown in FIGS. 5A and 5B. In this embodiment, packer 260 consists of several rings of swellable material 242 and several rings of sacrificial material 244 arranged alternately on the tool 260 along a longitudinal direction. The arrangement of rings is configured such that the volume reduction of the sacrificial material rings 242 corresponds to the expansion volume required for the swellable material rings 244. The displacement of solid particles of the gravel pack into the spaces created by the degraded or dispersed sacrificial material allows the swellable material rings to expand and form a series of annular barriers between the production tubing and the wellbore wall.

Figure 6A:
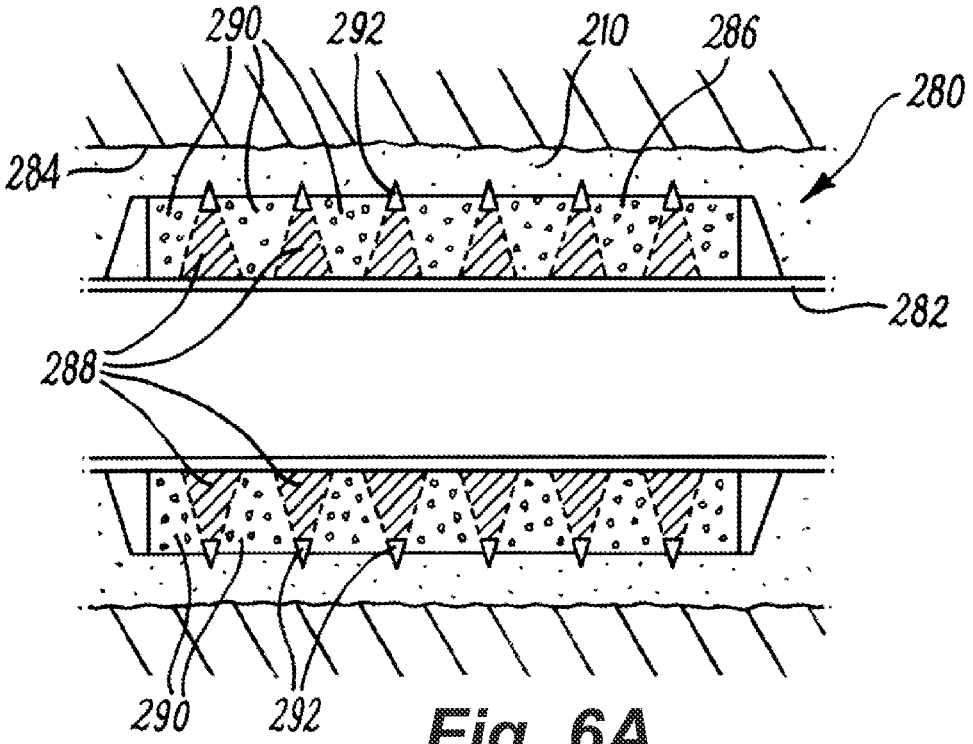
FIGS. 6A and 6B are schematic sectional views of a packer system in accordance with a yet further alternative embodiment of the invention, respectively before and after the formation of an annular barrier.
Figure 6B:
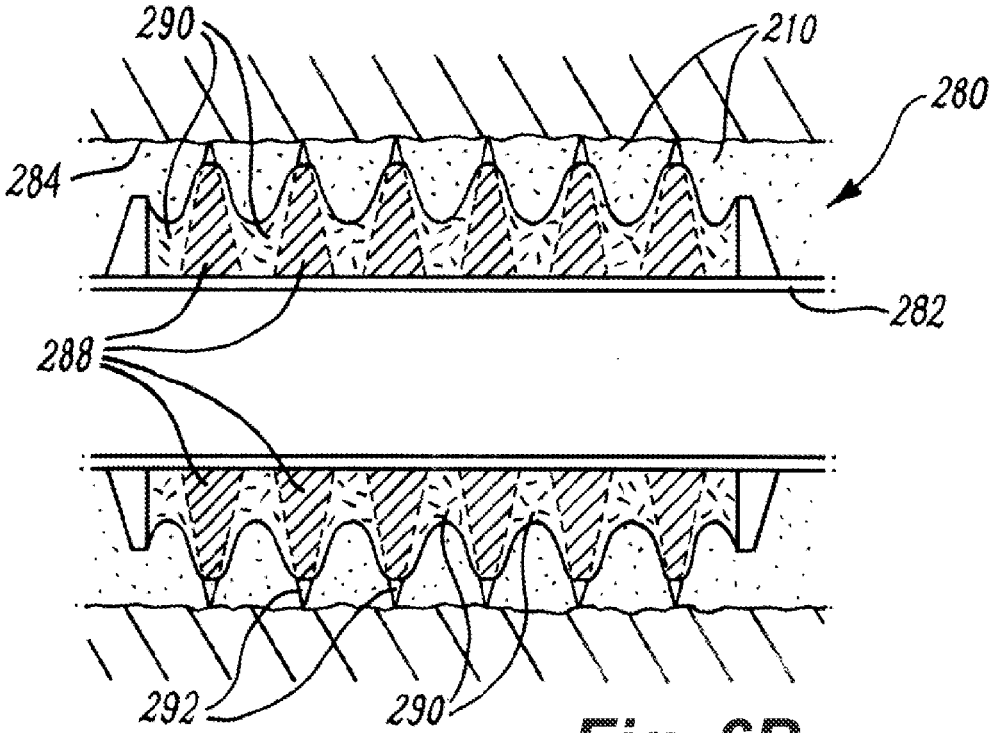

An alternative embodiment is shown schematically in FIGS. 6A and 6B. In this embodiment, a swellable wellbore packer 280 is located on a production tubing 282 in an openhole wellbore 284. The packer 280 comprises an expanding portion 286 between a pair of end rings. The expanding portion 286 has along its length a series of annular volumes 288 of swellable elastomeric material, selected to expand on exposure to a triggering fluid (such as hydrocarbons in the wellbore). The swellable annular volumes 288 are separated by annular volumes 290 of non-swelling elastomeric material, which alternate with the swellable annular volumes in a longitudinal direction along the packer. The non-swelling elastomeric material which forms the annular volumes 290 is relatively soft compared with the swellable elastomeric material which forms the annular volumes 288, and in this embodiment is an elastomeric foam which includes internal air spaces which are compressible. Disposed around the swellable volumes 288 are hardened seal rings 292 of metal which form the outermost radial point of the swellable volumes 288.

In use, the packer 280 is located in the openhole wellbore between production zones, and the gravel pack material 210 is placed around the packer and the adjacent sand control devices (not shown). The swellable material in the volumes 288 is exposed to wellbore fluid, and the resulting expansion of the material causes a swelling force to be directed radially outwards into the gravel pack 210. Penetration of the swellable material into the gravel pack is assisted by the relatively hard seal rings 292 which form a tapered seal edge. Gravel pack material is compressed by the expanding volume 290 into the region is located between the volumes 290 and the wellbore wall. This compression of gravel pack material transfers a force onto the non-swelling volumes 290. The relatively soft non-swelling material is compressed and reduces in volume, creating space into which the gravel pack material adjacent the volumes 288 can be displaced. The solid particles of the gravel pack may migrate into the relatively soft non-swelling rubber, while the rubber is soft enough to flow into the interstices between solid particles in the gravel pack.

The hardened seal rings 292 are tapered to improve penetration into the gravel pack 210 and to displace the solids towards the adjacent volumes of compressible material. The volumes of swellable material 288 are also tapered in a direction moving outward from the production tubing. This shape improves the expansion of the swellable material into the gravel pack 210, and requires less gravel pack material to be displaced than would an untapered volume. It will be appreciated that the volumes 290 of non-swelling elastomer may extend over a length which is greater than the swelling volumes 288 (i.e. the volumes 290 may be comparatively large). This means that the proportional reduction in volume due to compression to accommodate the displaced gravel pack material is small compared with the proportional expansion of the swellable volumes.

The embodiment of FIGS. 6A and 6B is particularly suited to low clearance applications where the wellbore inner diameter is only slightly greater (e.g. 0.25 to 1 inch) than the run-in outer diameter of the packer, and where the packer is only required to create an annular barrier which impedes flow but is not required to retain a high pressure differential. The embodiment is also particularly suited to horizontal or highly deviated wellbores, and also has particular application to openhole wells and/or sand formations (although cased hole applications are also practicable). This is because the softer non-swelling rubber provides a degree of support for the gravel pack and the formation at all times. No additional void space is created rapidly, which means that gravel pack solids are unlikely to fall in the annulus. The sand will be displaced gradually by the swelling elastomer and the volume will be absorbed into the non-swelling elastomer.

Although the volumes 290 are described above as "non-swelling" it will be appreciated that some degree of swelling is not precluded. However, swelling in the volumes 290 is required to be slower or delayed when compared with the swelling of the material in the volumes 288. The embodiment described includes hardened seal rings 292, but in other embodiments different formations or structural members of relatively hard material may be embedded into or disposed on the swelling volume to assist with penetration into the gravel pack. The relatively hard material may be a metal, composite, plastic or relatively hard elastomeric material, and may provide multiple initial point contacts or a circumferential line contact.

It will be appreciated that the features of the embodiment of FIGS. 6A and 6B may be used in combination with the features of previously described embodiments; for example, the volumes 290 may include a degrading elastomer or other solid material as described with reference to FIGS. 4 and 5, and/or the embodiments of FIGS. 4 and 5 may include hardened formations or structural members to assist with penetration into the gravel pack material. In a further alternative the material of volumes 290 may also allow impregnation of the solid particles from the gravel pack into the material.

Figure 7A:
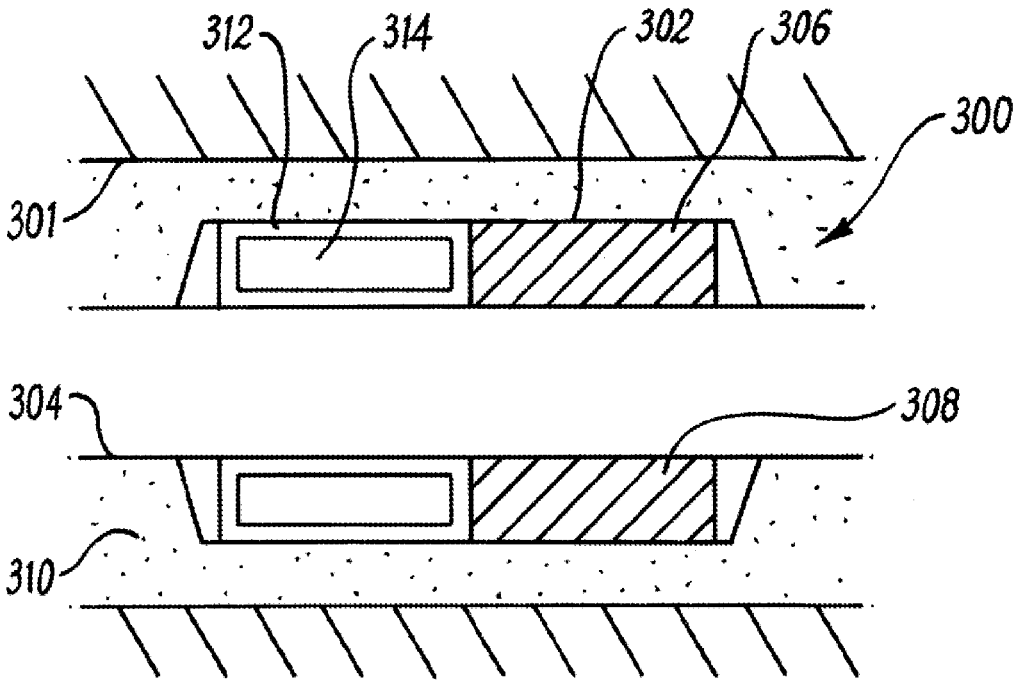
FIGS. 7A and 7B are schematic sectional views of a packer system in accordance with another embodiment of the invention, respectively before and after the formation of an annular barrier.
Figure 7B:
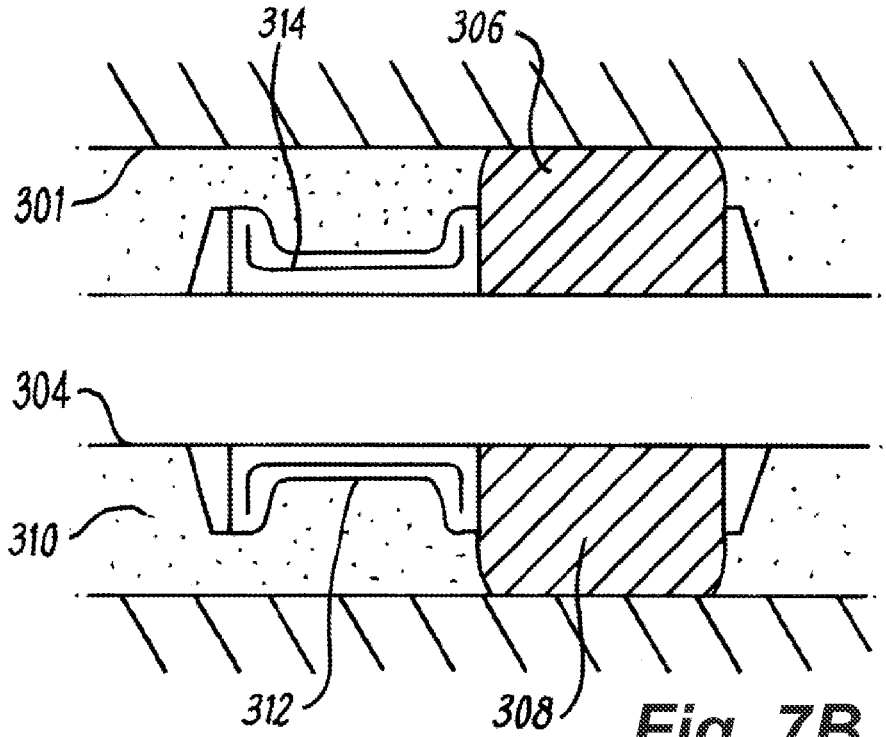

A further alternative embodiment of the invention is shown schematically in FIGS. 7A and 7B. In this embodiment, a swellable wellbore packer, generally depicted at 300, is shown in longitudinal section in an openhole wellbore 301 (although it will be understood that cased hole applications are equally suitable). The swellable wellbore packer 300 comprises a body 302 located between two end rings on a production tubing 304. The body comprises an expanding portion 306 which is formed from an annular volume of swellable elastomeric material 308, which is selected to increase in volume on exposure to a wellbore fluid. The packer 300 also includes an annular contracting volume 312, which is longitudinally separated from the expanding portion 306, and which is designed to decrease the volume that it occupies in the wellbore 301 during operation. The contracting volume 312 defines a chamber 314 in a run-in condition (shown in FIG. 7A). The packer 300 is configured to be run in hole and located between adjacent production zones with the chamber 314 at its full annular volume, in the condition shown in FIG. 7A. When the packer 300 is located in the correct position, gravel pack 310 is placed around the packer 300 and the adjacent sand control devices (not shown) in a conventional manner. With the gravel pack 310 in place, the swellable material 308 is exposed to wellbore fluids which trigger an increase in its volume. The adjacent contracting volume 312 is configured to change shape by collapse, contraction, or other deformation of the chamber 314 to decrease the volume occupied in the wellbore. This increases the size of the annulus in the wellbore 301 and creates a void for the gravel pack material 310 displaced by the swellable material 308 as it expands in the adjacent part of the wellbore.

In this simple embodiment of the invention, the chamber 314 is collapsible, and the gradual increase of volume of the swellable material 308 compresses the gravel pack material 310 which transfers a force to the contracting volume 312 to collapse the chamber 314. However, in some applications, the swelling forces of the preferred swellable materials 308 are low, and may not be capable of reducing the size of the contracting volume by compression alone, particularly because the contracting volume may be engineered to withstand significant forces from the gravel pack itself and wellbore fluid pressure without collapsing while the gravel pack is placed around the packer and sand control devices. Preferred embodiments of the invention therefore include features and techniques which facilitate operation of the contracting volume, such that collapsing does not rely on compression from the gravel pack material 310 alone.

Figure 8:
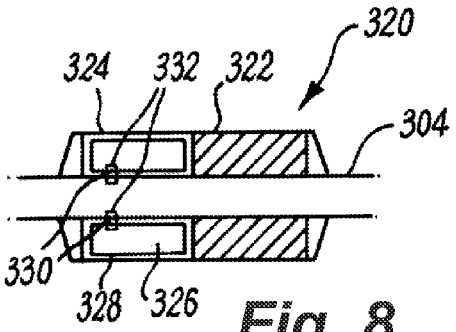
FIG. 8 is a schematic sectional view of a packer system having a contracting portion in accordance with an alternative embodiment of the invention.

Exemplary implementations of the principle of the embodiment of FIGS. 7A and 7B are shown in FIGS. 8 to 12 in schematic form. Features of these embodiments are shared with the packer 300, and will not be described in the interests of the brevity. In the embodiment of FIG. 8, the packer 320 comprises a swellable portion 322 and a contracting portion 324. The contracting portion 324 comprises a chamber 326 which includes a bladder 328 which is inflated with a fluid before run-in (and as shown in the drawing). Fluid ports 330 are located between the bladder 328 and the interior of the production tubing and provide a drainage path for evacuating fluid from the bladder 328. However, in a run-in condition the fluid ports are blocked with plugs 332 which retain the fluid in the bladder 328. The plugs 332 are configured to be sheared by a standard intervention operation (such as a slick line intervention) to allow fluid to pass out of the chamber and into the production tubing 304. The release of fluid pressure from the bladder 328 in the contracting portion 324 allows the annular portion to collapse inwardly, to create a space in the wellbore into which gravel pack solids can be displaced by the swelling of the swellable material in the swellable portion 322.

Although it is possible for the fluid to be drained from the bladder rapidly, there is a risk that the rapid change in volume could cause a resettling of the solid materials of the gravel pack in an uncontrolled manner, which includes displacement of solids from parts of the wellbore other than the annular space surrounding the swellable material. This may not allow sufficient displacement from the annular space immediately adjacent the swellable material, and therefore in some applications it may be desirable for the controlled release of the fluid over a time period which corresponds to the swelling profile of the swellable material.

Figure 9:
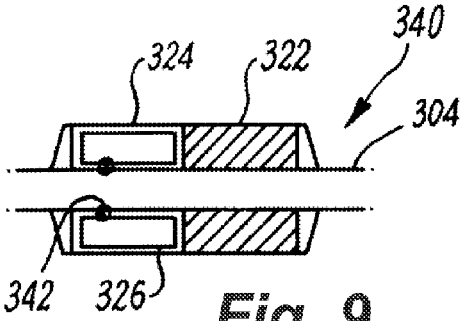
FIG. 9 is a schematic sectional view of a packer system having a contracting portion in accordance with an alternative embodiment of the invention.

In the embodiment of FIG. 9, the packer 340 is similar to the packer 320 of FIG. 8, with like components shown by like reference numerals. However, in this case, the fluid ports 330 are provided with valves 342 which control the flow of fluid from the bladder 328 at a controlled flow profile which corresponds to the swell profile of the swellable portion 322. By configuring the contracting portion annular portion 324 to reduce in volume at the same or similar rate to the expansion of the swellable portion 322, gravel pack material adjacent swellable portion can be gradually displaced into the increasing annular space created adjacent the contracting portion 324.

It will be appreciated that in a further alternative embodiment (not illustrated) a packer may comprise an arrangement of fluid ports comprising actuable plugs and fluid release valves. In a further alternative, the fluid ports may themselves be designed to choke the flow to a rate which corresponds to a contraction rate which matches the swell rate of the swellable material.

Figure 10:
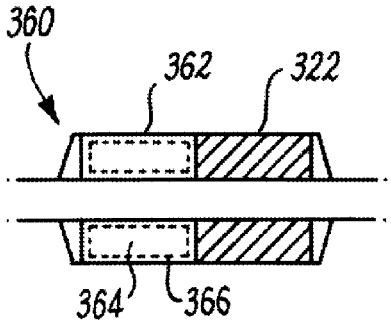
FIG. 10 is a schematic sectional view of a packer system having a contracting portion in accordance with a further alternative embodiment of the invention.

Turning now to the embodiment of FIG. 10, the swellable packer 360 comprises an annular contracting portion which has a fluid chamber 364 bounded by a selective permeability membrane 366. The fluid chamber 364 is filled with a viscous fluid, such as a gel (as described above) prior to run-in. The fluid is sufficiently viscous such that it does not pass through the selective membrane 366, and therefore fluid pressure is retained in the fluid chamber. This fluid pressure balances forces on the contracting volume during placement of the gravel pack. After a prolonged period at wellbore conditions, the elevated temperatures cause the fluid to degrade and the viscosity of the fluid to decrease until it is sufficiently non-viscous to pass through the membrane 366 and out of the fluid chamber 364 into the wellbore annulus. The fluid disperses, which allows the contacting portion to decrease in volume and create a space into which gravel pack materials may be displaced by swelling of the swellable portion 322.

It will be understood that although the embodiment of FIG. 10 describes a viscous fluid which changes properties under wellbore temperatures, other ways of achieving similar effects may be carried out in alternative implementations of the invention. For example, the fluid chamber 364 may comprise a viscous or gel-like material which cannot pass through the membrane 366, combined with a chemical breaker. The chemical breaker may be selected to break down the viscous fluid or gel after a predetermined period of time to a less viscous fluid which can permeate through the membrane to release fluid pressure in the annular chamber. Such materials are found amongst the industry standard gel and breaker systems commonly used in other downhole applications.

Figure 11:
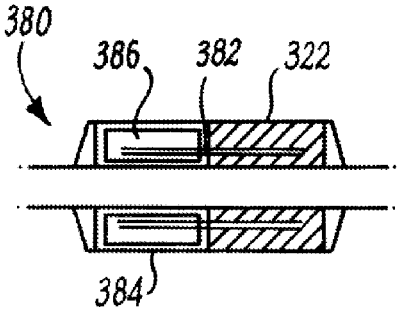
FIG. 11 is a schematic sectional view of a packer system having a contracting portion in accordance with another embodiment of the invention.

A further alternative embodiment of the invention is shown schematically in FIG. 11. In this embodiment, the swellable wellbore packer 380 comprises a fluid communication channel 382 between the contracting portion 384 and the swellable portion 322. The fluid contained in the chamber 386 of the contracting portion is a triggering fluid for the swelling portion 322. The fluid communication channel, which in this case is a porous or fibrous wicking material, extends from the fluid chamber 386 into the swellable material, and provides a fluid path for fluid to exit from the chamber. As the fluid is absorbed by the swelling material, it increases in volume and the volume of the annular chamber 386 correspondingly decreases to allow gravel pack particles in the wellbore annulus to be displaced as the swellable material expands.

Figure 12:
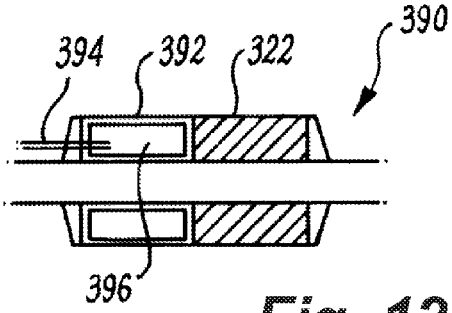
FIG. 12 is a schematic sectional view of a packer system having a contracting portion in accordance with an alternative embodiment of the invention.

In the embodiment of FIG. 12, the swellable packer 390 comprises a contracting portion 392 which has a fluid control line 394 running from surface to the fluid chamber 396. The fluid control line 394 allows controlled evacuation of the fluid chamber 396 at an appropriate time and rate to allow the contracting portion to decrease in volume and provide a void for gravel pack solids displaced by the swellable member.

Figure 13A:
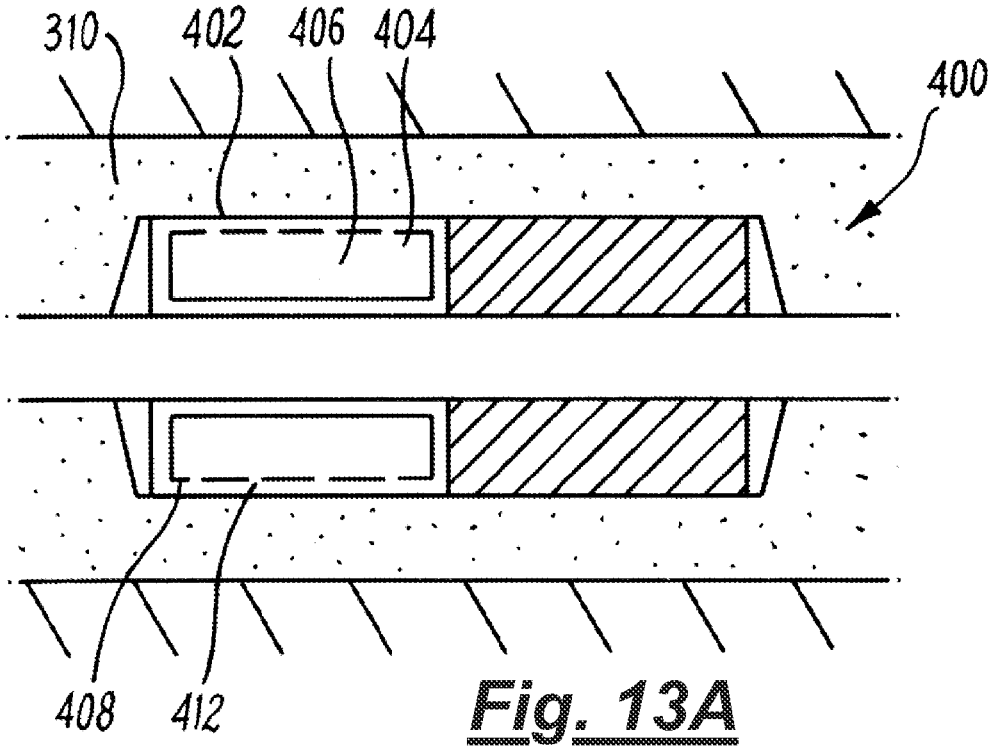
FIGS. 13A and 13B are schematic sectional views of a packer system in accordance with an alternative embodiment of the invention, respectively before and after the formation of an annular barrier.
Figure 13B:
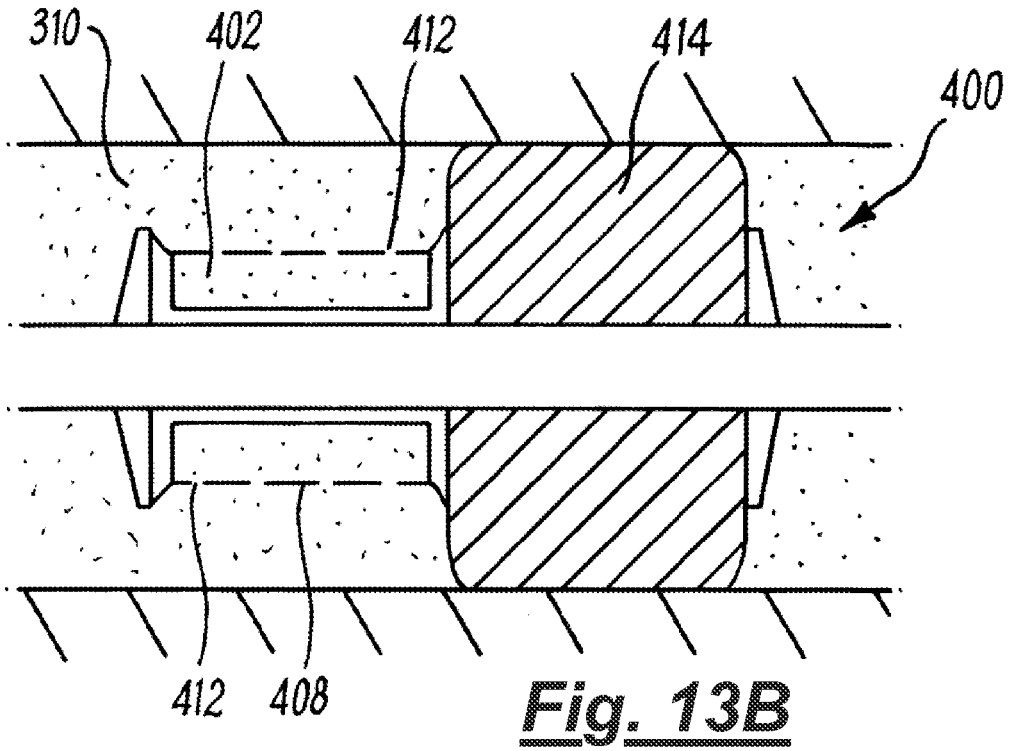

An alternative embodiment of the invention in FIGS. 13A and 13B. This embodiment is similar to the embodiments described with reference to FIGS. 7 to 12 and will be understood from the accompanying description. However in this case, the swellable wellbore packer, generally depicted at 400, comprises a contracting portion 402 which includes a chamber 404 containing a void 406. In order to allow the contracting portion to withstand wellbore forces, such as forces from the hydrostatic pressure of the gravel pack 310, a mechanical support structure in the form of a reinforcing cage 408 is provided around the chamber 404, to provide additional mechanical structural support and to resist radial and/or axial compression. The contracting portion 402 is provided with an outer layer 410 of elastomeric material which seals the chamber 404 in a run-in condition, as shown in FIG. 13A. The material of the outer layer 410 degrades in wellbore conditions. After a prolonged period in the wellbore, as shown in FIG. 13B, the outer layer 410 has degraded to expose openings 412 in the mechanical support structure 408. This opens up the void 406 to solid particles of the gravel pack, allowing them to be displaced into the void as the swellable material of the adjacent expanding portion 414 expands to form an annular barrier (as shown in FIG. 13B).

An alternative embodiment of the invention is now described with reference to FIGS. 14A to 14D. In this embodiment, the swellable wellbore packer, generally depicted at 420 comprises an expanding portion 422 and contracting portion 424 which is located longitudinally adjacent the expanding portion on a production tubular. The contracting portion 424 is provided with an arrangement of self-inflating internal cavities or voids 426. The cavities 426 in this embodiment are shown as discrete annular chambers, although alternative embodiments could comprise arrangements. For example, the cavities may comprise a complex network of pores, cavities or voids with different sizes or distribution, such as an open foam structure. The function of the internal cavities 426 is primarily to allow the contracting portion 424 to change volume (i.e. contract) in use, and secondarily to take on fluid to assist in maintaining the annular volume during run-in and placement of a gravel pack, as will be described below.

The contracting portion 424 comprises an outer surface 428 which prevents passage of fluid between the exterior of the contracting portion 424 and the internal cavities 426. However, several fluid ports 430 arranged between the exterior and the interior of the contracting portion 424 through the outer surface 428. Located in the fluid ports 430 are valves 432 which control the passage of fluid between the interior and the exterior of the contracting portion 424. In a run-in condition, shown in FIG. 14A, the cavities 426 are vacated of fluid, comprising air or an inert gas at ambient pressure. The valves 432 are one-way valves which permit in-flow of fluid from the exterior of the swellable packer 420 and into the interior volume defined by the contracting portion 424. During run-in, the packer 420 is exposed to an increasing hydrostatic pressure from wellbore fluids. The hydrostatic pressure in the wellbore is sufficient to overcome the back pressure of the valves 432, such that wellbore fluid flows into the cavities 426 in the contracting portion, as shown schematically in FIG. 14B. Thus the contracting portion 424 becomes loaded with wellbore fluid, and increasing wellbore pressure causes additional fluid to enter the cavities 426. This increases the internal cavity pressure until it balances the wellbore pressure, preventing collapse of the contracting portion 424. Fluid is retained in the cavities by the valves 432 and therefore even if the wellbore annulus pressure is reduced, the contracting portion does not reduce in volume. This pressure loading of the contracting portion 424 allows it to resist compression forces from the gravel pack material as it is placed around the packer 420 and adjacent sand control devices.

Figure 14A:
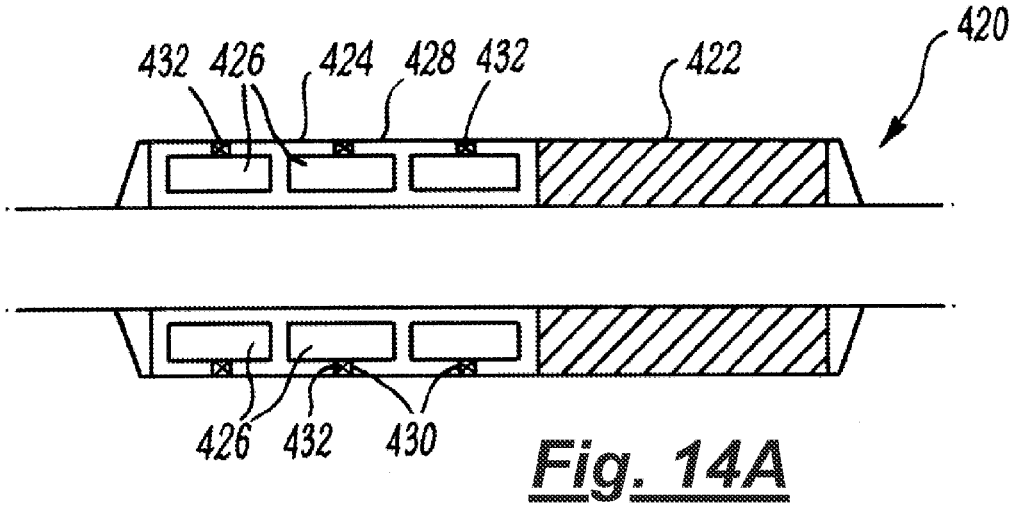
FIGS. 14A to 14D are schematic sectional views of a packer system in accordance with a further alternative embodiment of the invention, shown in various stages of its deployment.
Figure 14B:
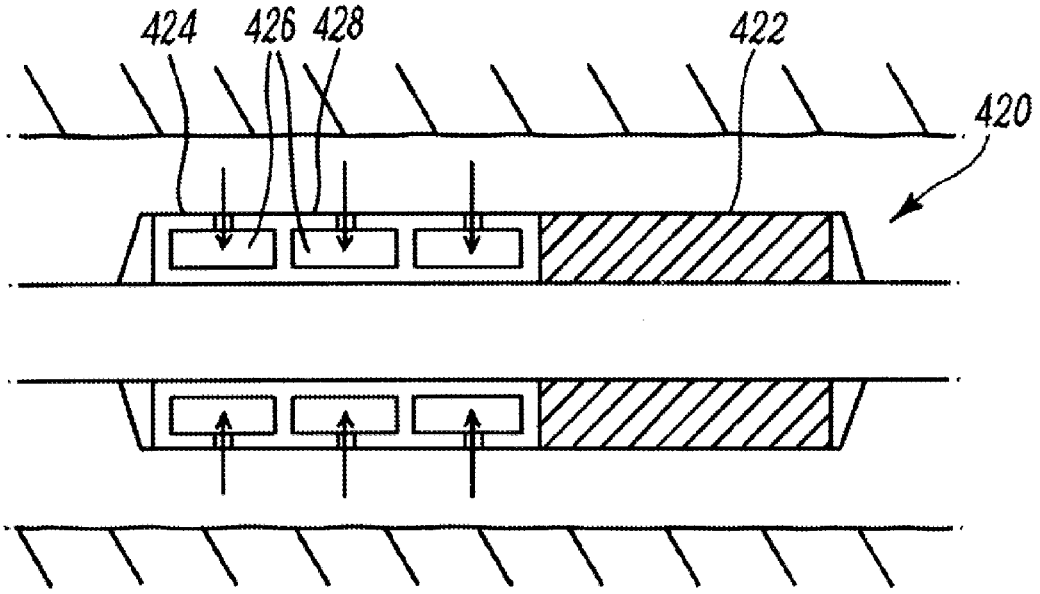
Figure 14C:
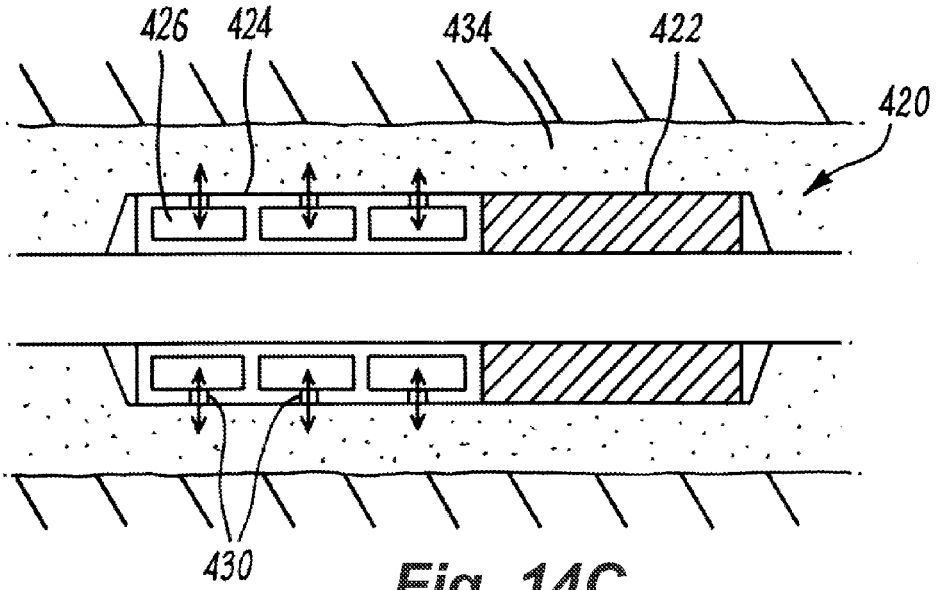

The valves 432 in the fluid ports 430 contain components formed from which degrade under prolonged exposure to elevated temperatures, such as those experienced in a wellbore. The valves retain their integrity, and therefore function as one-way valves to retain pressure in the internal cavities 426, for a period of time sufficient for run-in and placement of the gravel pack. However, after a prolonged period in the wellbore, the valves are affected by wellbore conditions and begin to degrade. FIG. 14C shows the packer 420 located in an openhole after the gravel pack 434 has been placed, and after the valves have degraded. In this condition the valves no longer prevent the outward flow of the fluid from the internal cavities. Therefore fluid is allowed to pass in and out of the cavities, as indicated by the arrows.

Figure 14D:
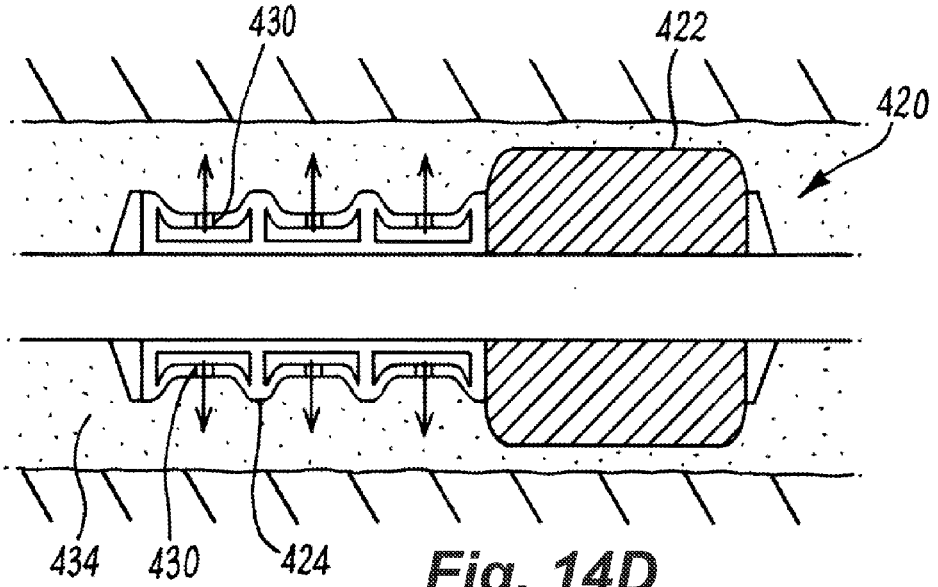

FIG. 14D shows the swellable wellbore packer 420 partway through expansion of the swellable material of the expanding portion 422 due to exposure to wellbore fluids. This causes a force on the solid gravel pack material, which is transferred to the contracting portion 424. Fluid passes out of the fluid ports 430, which allows the contracting portion 424 to be deformed and compressed. The consequential reduction in its volume creates space in the wellbore annulus for solid gravel pack particles to be displaced by the swelling of the swellable material, as described with respect to previous embodiments.

In the text above, there are described various approaches to gravel pack deployment and isolation which use the creation of one or more spaces, voids or cavities to allow gravel pack material to be displaced by an expanding swellable wellbore packer element. In some applications, the wellbore geometry (including run-in outer diameter, borehole size, and wellbore inclination), swellable material choice and/or the nature of gravel pack material will allow the gravel pack particles to be gradually displaced into the void. However, certain embodiments of the invention incorporate a specialised packer design which facilitates displacement of the gravel pack solids as will be described below.

Figure 15A:
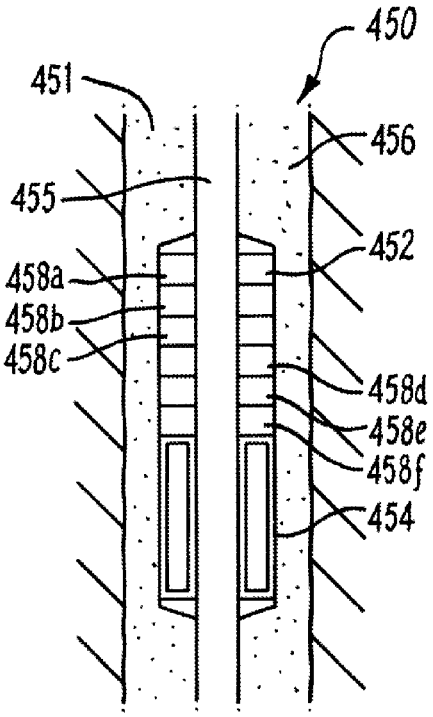
FIGS. 15A and 15B are schematic representations of a packer system according to an alternative embodiment of the invention, respectively before and during formation of an annular barrier.

FIG. 15A shows in longitudinal section an example of swellable wellbore packer system which may advantageously be used with the gravel pack systems of the present invention. The swellable packer, generally depicted at 450, is shown in a substantially vertical portion of an openhole wellbore 451. As with previous embodiments, the wellbore packer 450 comprises an expanding portion 452 located above (that is, closer to the surface) a contracting portion 454 between a pair of end rings on a production tubing 455. As before, the swellable wellbore packer 450 forms part of a production system comprising a number of sand control devices (not shown) designed for use with a gravel pack 456. In FIG. 15A, the gravel pack 456 is placed around the packer system 450.

The expanding portion 452 comprises a swellable material which increases in volume upon exposure to a wellbore stimulus (such as a wellbore fluid) and the contracting portion 454 is designed to decrease in volume to create a void into which gravel pack material can be displaced as the swellable material increases in volume. However, the expanding portion 452 of this embodiment differs from previous embodiments in that the swellable material in different regions of the expanding portion increases in volume at different rates. In this embodiment, this is achieved by providing rings 458 of swellable elastomeric material which swell at different rates in response to contact with wellbore fluid. An upper ring 458*a* of the swellable material (which is closest to the surface of the wellbore and furthest from the contracting portion) swells at the fastest rate. An adjacent ring 458*b* of the swellable portion swells at a slightly lower rate, and successive rings of the expanding portion 458*c*, 458*d*, 458*e* and 458*f* each swell at slightly slower rates than the ring located immediately above. This means that the expanding portion swells progressively from its upper end 460 to its lower end 462.

Figure 15B:
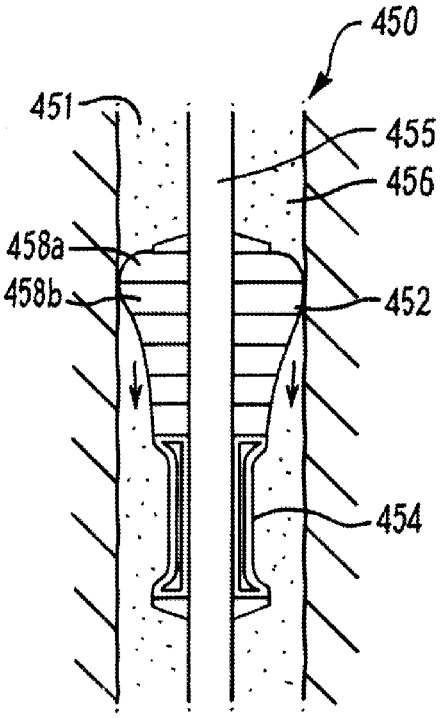

In use, as will be understood from previous embodiments, the contracting portion 454 reduces in volume simultaneously with the increase in volume of the expanding portion 452. In the embodiment of FIGS. 15A and 15B, the initial swelling of the upper ring 458*a* of the expanding portion will impart force on the gravel pack solids. The decreasing volume of the contracting portion 454 in a vertically lower position allows gravity to assist in the displacement of the gravel pack material in a downward direction. This allows all of the gravel pack material adjacent to the upper ring 458*a* to be displaced before an adjacent ring 458*b* and lower rings 458 of the expanding portion have fully swollen into contact with the wellbore wall. During the progressive swelling of the expanding portion 452, gravel pack material is gradually displaced downwards from the annular space in the upper areas, assisted by gravity, and is not blocked from moving to the intended area (i.e. the void created adjacent to the contracting portion). This prevents gravel pack material from bridging between the expanding portion 452 and the wellbore wall, which results in good contact between the swellable material and the wellbore wall, forming an annular barrier or wellbore seal with greater isolation and pressure retaining capabilities.

Although the expanding portion is shown here sub-divided into six rings 458 of swellable material, it will be appreciated that in alternative embodiments the swellable portion may be sub-divided into a greater or lesser number of rings.

It will also be appreciated that the expanding portion need not be formed by providing adjacent rings of elastomeric material with different swelling properties, and other techniques may be used to control the swelling of the material so that it swells progressively in a pre-determined direction. For example, a coating or layer which impedes swelling may be provided on the exterior of the swellable material. This may be selectively applied to different regions of the expanding portion, or provided in different thicknesses or quantities over different regions. Alternatively or in addition, the swellable material may be configured to have varying degrees of cross-linking in the elastomeric material in different regions of the expanding portion (it being understood that a high density of cross-linking in a swellable elastomer results in a slower swell rate compared to an elastomer having relatively low cross-linking). Alternatively or in addition, the surface area of different regions of the swellable material may be varied to affect the swell rate. This may be achieved for example, by introducing perforations on the outer surface of the swellable material, with a greater density of perforations over those areas which are required to swell at the greatest rate. In a further alternative, coatings or layers which impede swelling but which degrade in wellbore conditions at different rates may be applied to the outer surface of the expanding portion. It will be appreciated that the principles of this embodiment of the invention may also be achieved using a unitary body of swellable elastomeric material.

Figure 16A:
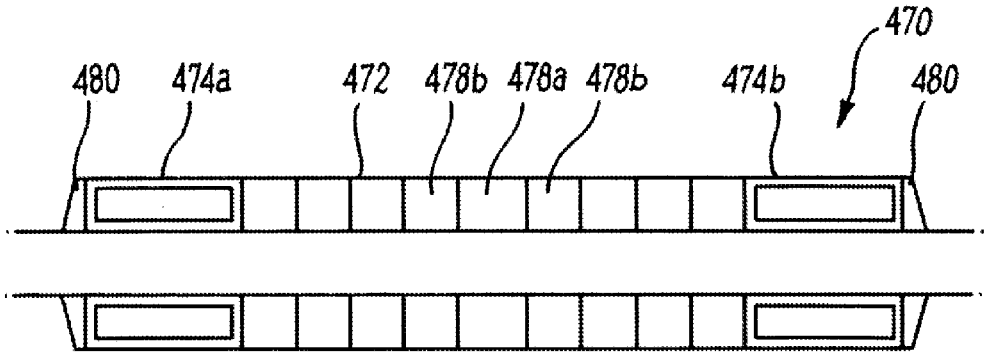
FIGS. 16A and 16B are schematic sectional views of a packer system in accordance with an alternative embodiment of the invention, respectively in a run-in condition and during formation of an annular barrier.
Figure 16B:
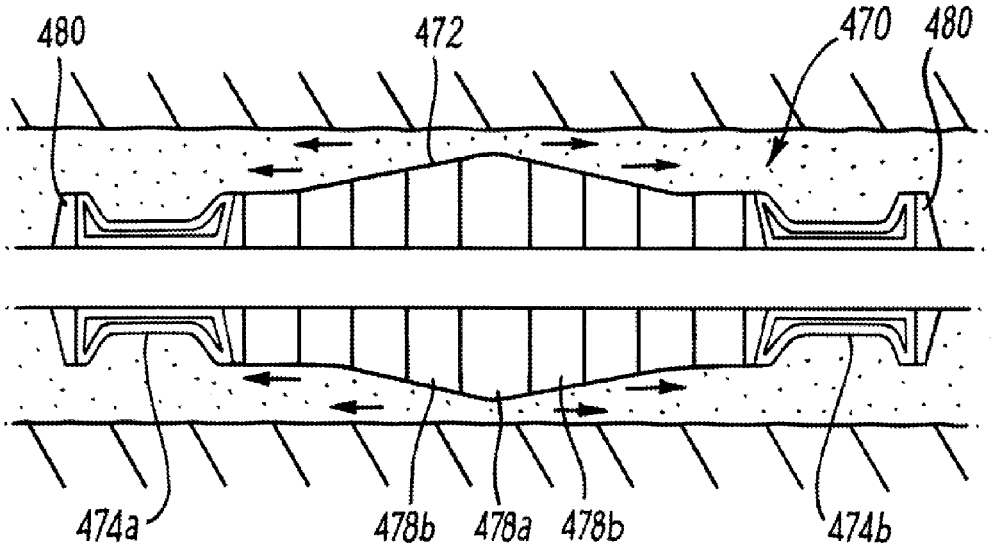

The embodiment of FIGS. 15A and 15B is shown in a substantially vertical wellbore, although it will be appreciated that the gravity assisted movement of gravel pack material may also be used in an inclined wellbore. Similar effects may also be achieved in a substantially lateral wellbore. FIGS. 16A and 16B show schematically an embodiment which also uses the progressive swelling principle illustrated with respect to the embodiment of FIGS. 15A and 15B. In this embodiment, the swellable wellbore packer 470 is formed between a pair of end rings on a production tubing 475. In FIG. 16A, the wellbore packer 470 is shown in a run-in condition on the production tubing, and comprises an expanding portion 472 located between a pair of contracting portions 474*a* and 474*b*. In this embodiment, the expanding portion 472 is again formed from a swellable material, and is designed to progressively swell from a longitudinally central region 478*a* outwards towards the end rings 480. In use, as shown in an openhole wellbore in FIG. 16B, initial swelling of the central swellable region 478*a* causes compression of the gravel pack material and displacement outwards towards the voids created by the contracting portions 474*a*, 474*b*, as indicated by the direction of the arrows. Outwardly adjacent regions 478*b* of the expanding portion swell progressively to cause gradual displacement of the gravel pack material while reducing the prospects of bridging, resulting in the creation of a more reliable annular barrier.

Alternative embodiments of the invention will now be described with reference to FIGS. 17 to 19. These embodiments are similar to one another in that in use they are operable to provide access to a concealed volume into which the gravel pack solids can be displaced.

Figure 17A:
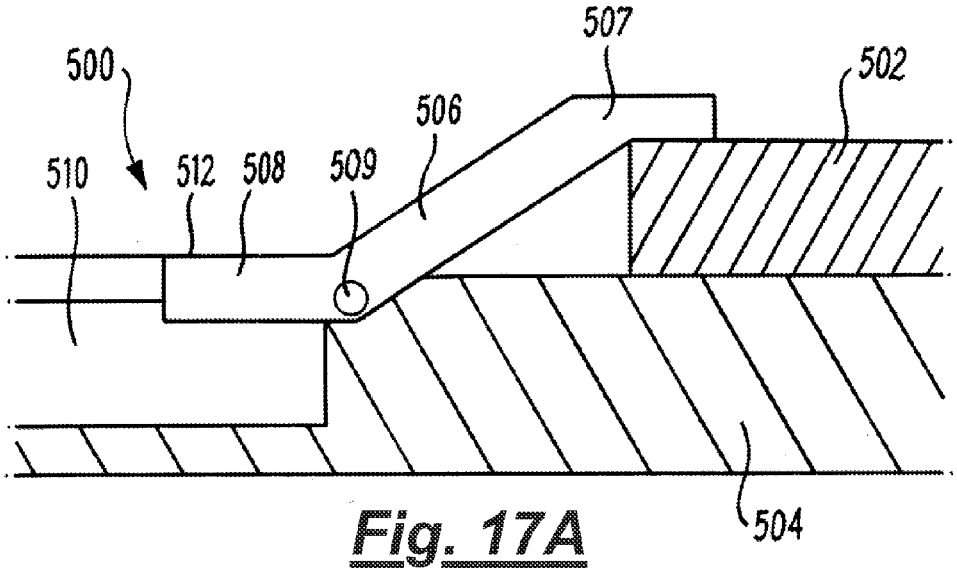
FIGS. 17A and 17B are schematic sectional views of a detail of a packer system of an alternative embodiment of the invention, incorporating a void opening mechanism in the form of a movable end member shown respectively in closed and open positions.
Figure 17B:
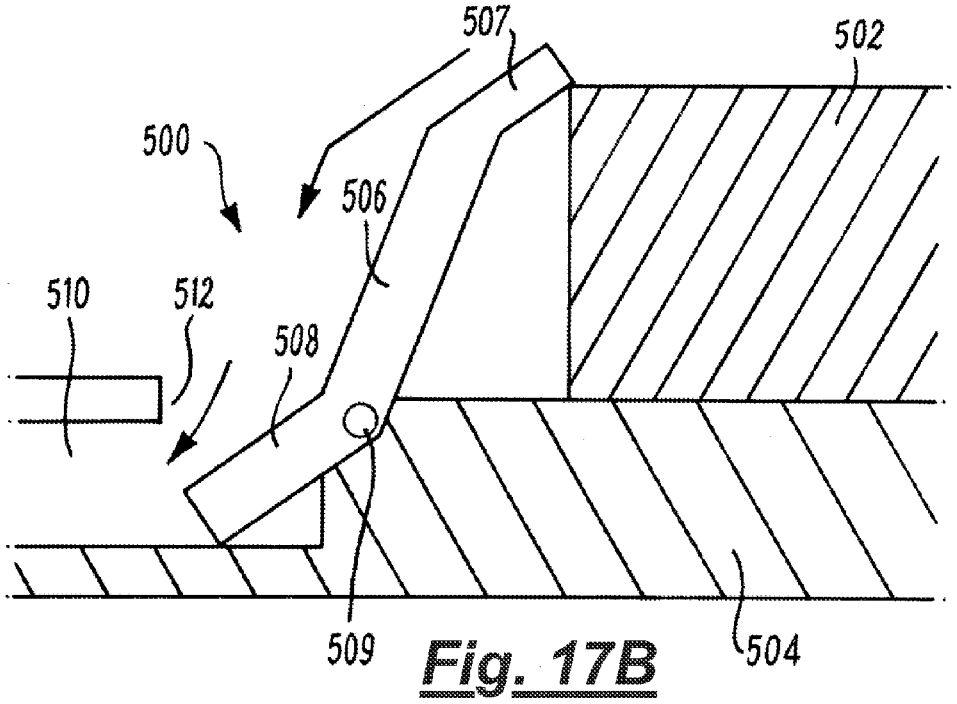

Referring firstly to FIGS. 17A and 17B, there is shown a detail of a packer assembly 500 which includes a swellable element 502 disposed on a modified base pipe 504. The packer assembly comprises a movable end member 506, which is located on the base pipe 504 and surrounds the end of the swellable element 502. Only one part of the packer is shown here in a sectional view, but it will be appreciated that the swellable element 502 is annular, extending around the base pipe 504. The end member 506 slopes upwards from the base pipe 504 at its connection point and proximal portion, and overlaps the swellable element 502 at its distal end. One end member 506 is shown in the drawing, but the packer assembly 500 comprises multiple end members 506 separated circumferentially around the assembly. The movable end member 506 is connected to the base pipe 504 by a pin 509 which allows it to pivot. As it pivots it increases the radial position of a distal end 507 of the member 506 moves away from a central axis of the assembly as the swellable element expands (as shown in FIG. 17B).

The modified base pipe 504 includes an internal annular void 510, which is provided with circumferentially spaced windows 512 (one shown in the drawing) to the outer surface of the packer assembly 500 (i.e. the wellbore annulus in use). In a run-in configuration, the windows 512 to the internal void are concealed and closed by a flap 508 on the proximal portion of the end member 506, preventing gravel pack solids from passing into the void 510. The swellable packer assembly 500 therefore defines a fixed annular volume during run-in and during the placement of a gravel pack material around the packer and the adjacent sand control devices (not shown). After a prolonged period in wellbore conditions, the swellable material of the element 502 (having been exposed to wellbore triggering fluid) increases in volume, as shown in FIG. 17B. The swell forces from the swellable element cause the end member 506 to pivot as the distal end 507 is pushed outwards. Movement of the end member 506 causes the proximal portion to pivot, moving the flap 508 to uncover the window to the void 508. This provides access to a volume into which solid materials of the gravel pack can be displaced (in the direction of the arrows) as the swellable member 502 expands.

Figure 18A:
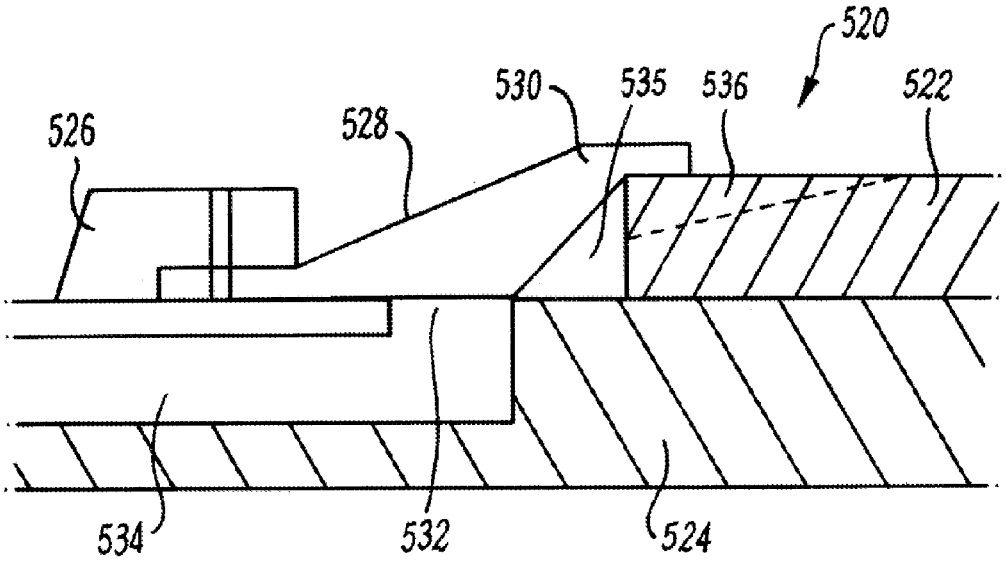
FIGS. 18A and 18B are schematic sectional views of the detail of an alternative packer system, including a void opening mechanism in the form of a movable back-up assembly shown respectively in open and closed conditions.
Figure 18B:
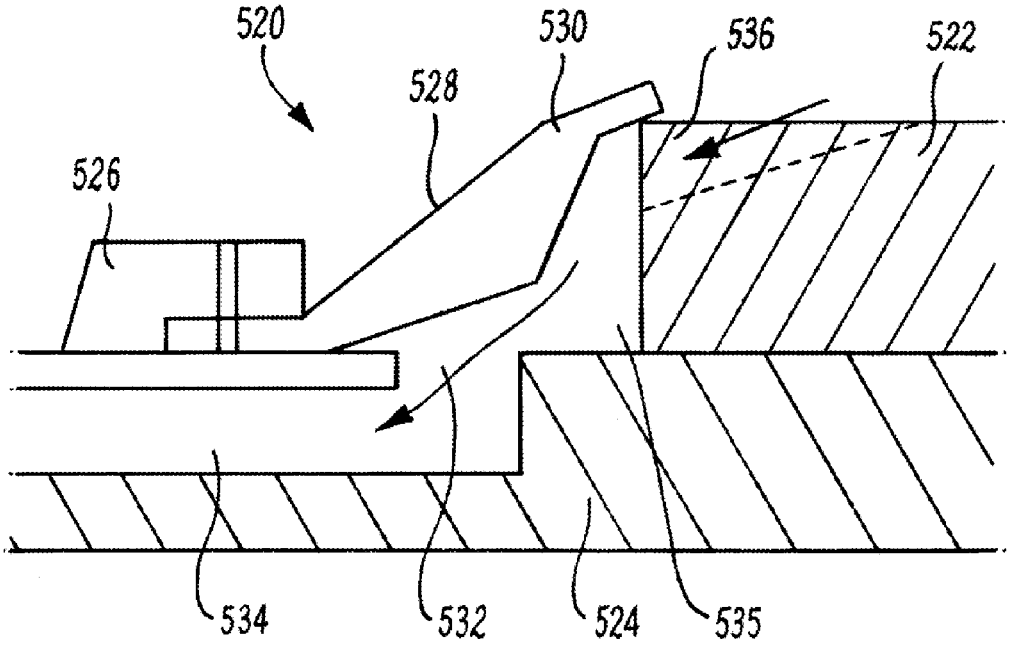

FIGS. 18A and 18B illustrate a further alternative embodiment of the invention. The drawings show a detail of a swellable packer assembly 520, similar to the packer assembly 500, which will be understood from FIGS. 17A and 17B and the accompanying description. As before, the swellable packer assembly 520 comprises a swellable element 522 located on a modified base pipe 524, and an end ring 526 which supports a movable back-up assembly 528. The back-up assembly 528 consists of an arrangement of overlapping pivoting leaves 530 circumferentially arranged on the base pipe 524 to substantially cover the end of the swellable element 522. Such back-up structures are known in the art, for example from the applicant's international patent publication number WO2008/062186 (incorporated herein by reference), which is designed to resist extrusion of the swellable material in use. However, in this embodiment, the back-up structure conceals and covers windows 532 to an annular volume 534 in the modified base pipe.

Figure 19:
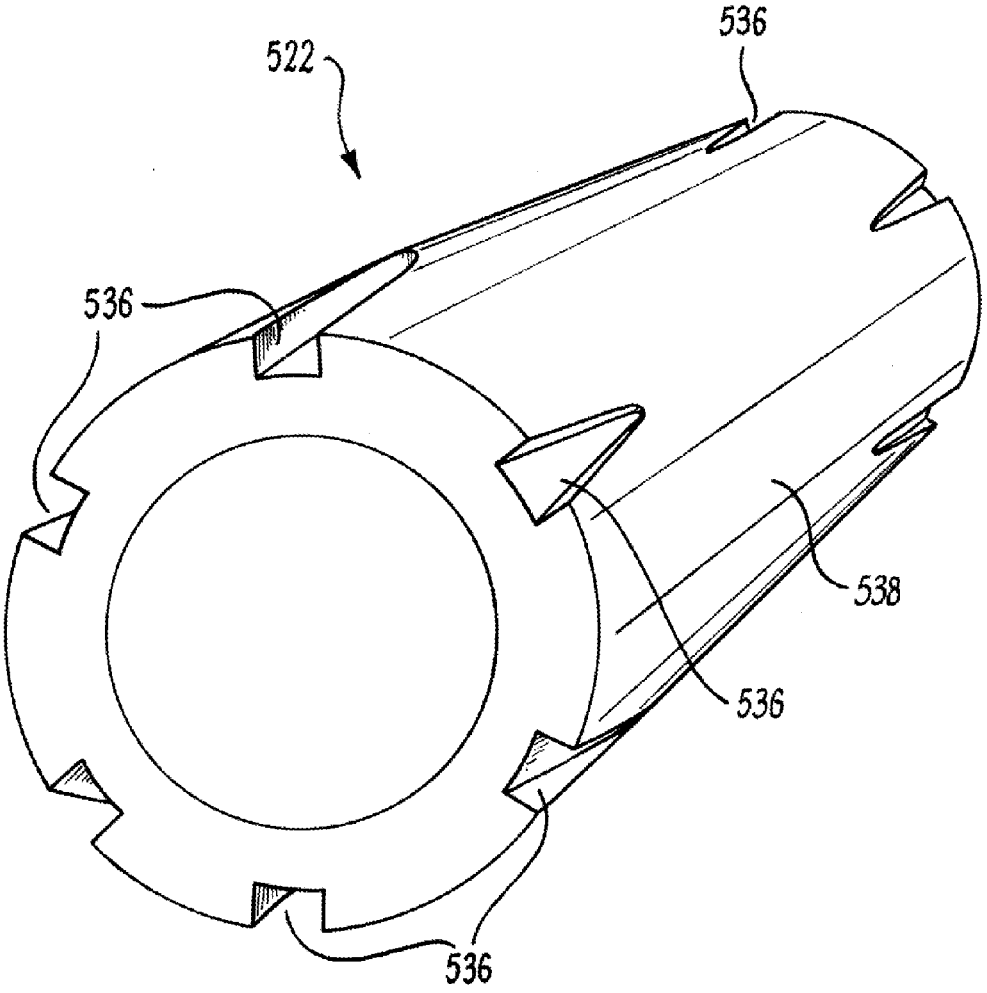
FIG. 19 is a perspective view of a swellable packer element that may be used in the embodiment of FIGS. 18A and 18B.

The swellable member 522 of this embodiment is provided with a number of tapered relief channels 536 spaced circumferentially on the swellable member, as most clearly shown in FIG. 19 (for clarity, FIG. 19 shows the swellable member in isolation, without the back-up assembly 528 and without the base pipe 524). The swellable member 522 consists of a body of a swellable elastomeric material, formed by conventional methods into an annular mantle. At each end of the swellable member 522, longitudinal tapered channels 536 are machined into the outer surface 538 at circumferentially separated locations. The channels 536 taper downwards from a position located towards the longitudinal centre of the swellable body 502, where they are at their shallowest and narrowest, and are widest and deepest at the end swellable body 502. The ends of the channels 536 are open. When assembled in the packer assembly 520, the back-up assembly 528 surrounds the swellable member 522 and is in contact with the outer surface of the rubber at the distal ends of the pivoting leaves 530. However, in the position of the channels 536, an open path is provided between the annular space on the outside of the swellable member 502 and the space 5 located between the back-up assembly 528 and the base pipe 504.

In use, the swellable packer assembly 520 is located in the wellbore in the run-in condition shown in FIG. 18A. Subsequently, with the packer in position between two production intervals, the gravel pack is placed around the swellable packer assembly and adjacent sand control devices (not shown). The swellable packer assembly 520 initially defines an annular volume around which the gravel pack is formed. After a prolonged period in wellbore conditions, the swellable material is exposed to a triggering fluid and expands. FIG. 18B shows the swellable member 522 partially expanded. The radial expansion deploys the individual leaves of the back-up assembly 528, as shown in FIG. 18B. This lifting of the backup assembly 528 uncovers the windows 532 to the internal void 534, and provides a path for solid particles of gravel pack material to be displaced into the void (as indicated by the direction of the arrows), via the channels 536 and the space 535.

The text above describes various apparatus and methods for the formation of an annular barrier and/or production zone isolation gravel pack operations which use changes in apparent volume in the annulus to facilitate displacement of the gravel pack solids which might otherwise impede swelling. However, it is also within the scope of the invention to use preferential flow and gravel pack solids placement to facilitate subsequent isolation. Two specific configurations for applications contemplated by the invention are illustrated in FIGS. 20 and 21.

Figure 20A:
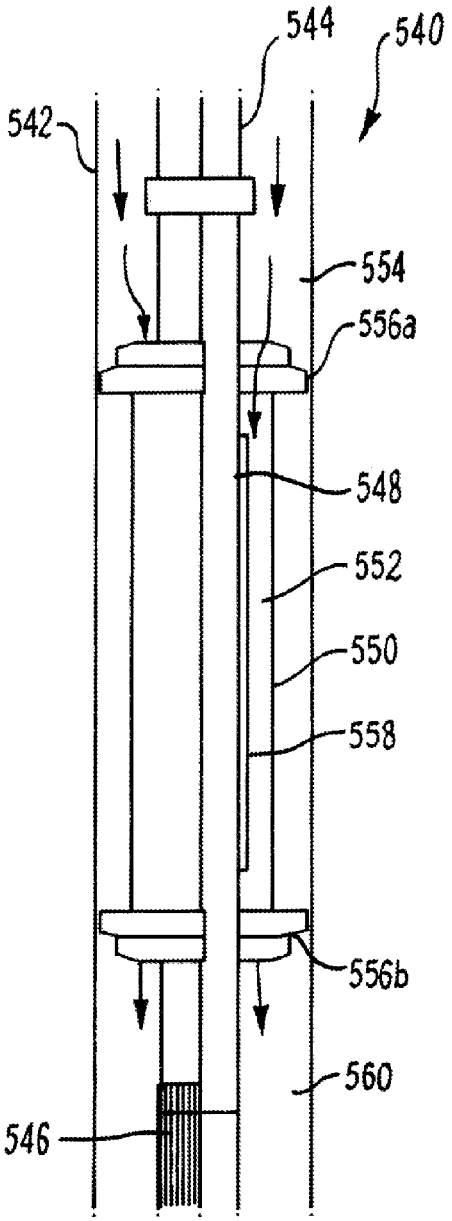
FIGS. 20A and 20B are part sectional views of a packer system configuration according to an embodiment of the invention before and after gravel pack placement and zonal isolation respectively.
Figure 20B:
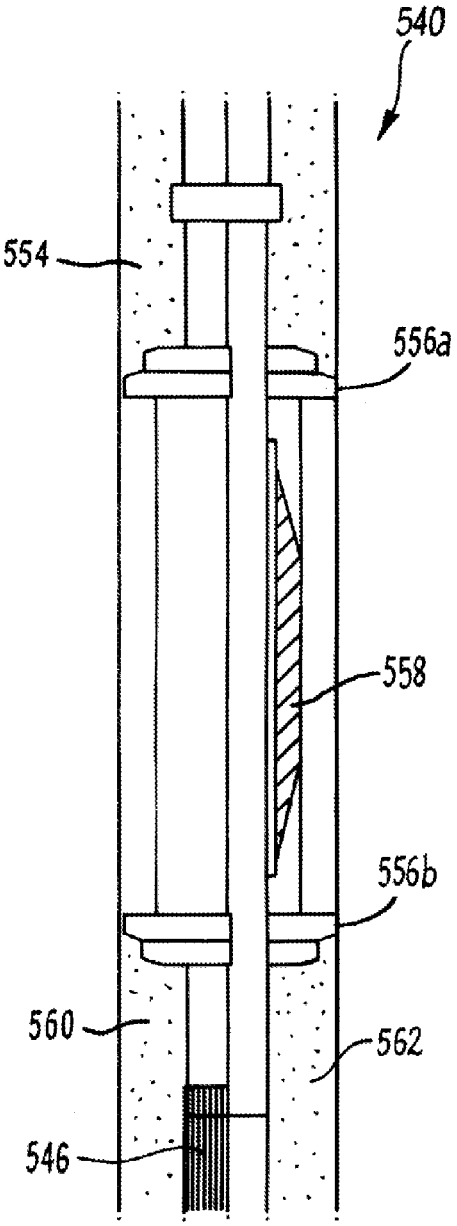

Referring to FIGS. 20A and 20B, there is shown schematically a swellable packer system 540 located in a cased well 542. The drawings show the system partly from an outer elevation (left hand side) and partly in sectional view (right hand side). The packer system 540 is configured to be coupled into a production tubing 544 with sand control devices 546, and comprises an inner mandrel 548 which provides a continuous bore with the production tubing 544. An outer mandrel 550 is concentric with the inner mandrel 548, and defines an internal annular bypass 552 to the main wellbore annulus 554 between upper and lower cup packers 556*a*, 556*b*. An annular swellable element 558 is located around the inner mandrel in the annular bypass 552. In use, a gravel pack slurry is pumped from surface down the wellbore annulus 554 between the production tubing and the casing, and is diverted through ports (not shown) in the upper cup packer 556*a* into the internal annular bypass defined by the inner and outer mandrels 548, 550. The gravel pack slurry is pumped past the unexpanded swellable packer element 558 in the internal annular bypass 552, and then is diverted through the lower cup packer 556*b* via ports (not shown) and into the lower portion 560 of the wellbore annulus. Fluid returns pass through the lower screen 546, depositing gravel pack solids in the lower part of the wellbore annulus 560 around the sand control devices. As the lower screens 546 are covered, the pressure drop across the lower screens ceases fluid returns through the lower screens. Instead, the fluid returns pass through the upper screens (not shown) causing gravel pack solids to be deposited in the upper annular space above the upper cup packer 556*a*. With fluid flow through the annular bypass 552 having ceased, gravel pack solids are no longer transported by the fluid flow into the internal annular bypass. Thus although gravel pack slurry (including solids and carrier fluid) is present in the annular bypass 552, solids do not accumulate in the annular bypass 552. Gravel pack solids are placed above the upper cup packer 556*a* to cover the upper screens (not shown) until the gravel pack is completed.

When fluid flow has ceased, the upper cup packer 556*a* prevents the internal annulus from filling with sand, which would otherwise occur by settlement of the gravel pack solids due to gravity. This limits the volume of gravel pack solids which are present in the internal annular bypass to those solids which were suspended in the volume of slurry occupying the annular space. Over time, the swellable elastomer material of the packer element 558 increases in volume in the internal annular bypass. The volume occupied by the solid particles of the gravel pack in the annular is sufficiently low to allow the swellable element 558 to expand to contact the inner wall of the outer mandrel 550 and seal the annulus against further fluid flow through the system. Therefore with the embodiment of FIGS. 20A and 20B, full isolation of adjacent production zones is achieved by the combination of the cup packers 556 and the swellable element 558 located in the internal annular bypass.

Figure 21A:
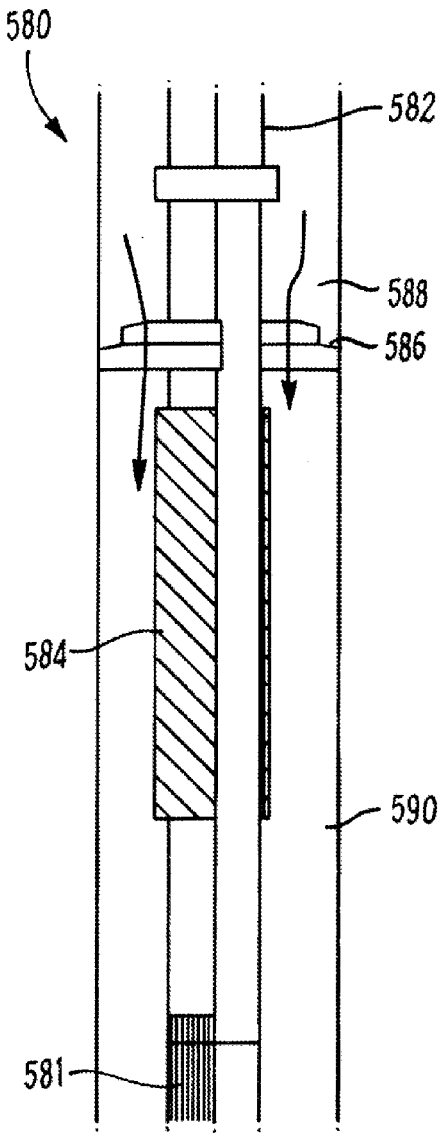
FIGS. 21A and 21B are part sectional views of a packer system configuration according to an embodiment of the invention before and after gravel pack placement and zonal isolation respectively.
Figure 21B:
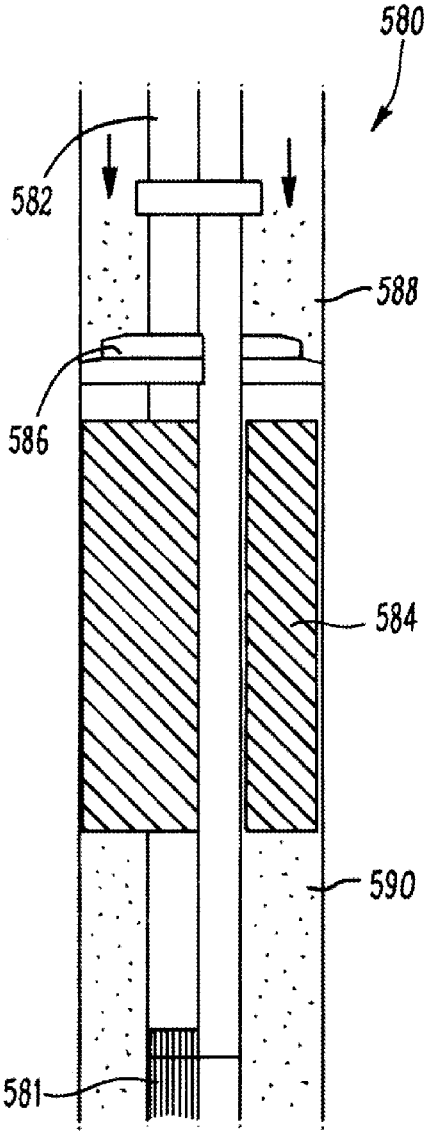

A further alternative embodiment of the invention is shown in FIGS. 21A and 21B. This embodiment is similar to the system 540, and will be understood from FIGS. 20A and 20B and the accompanying text. The swellable packer system 580 is coupled into a production system which has sand control devices 581 and a production tubing 582. As before, a swellable packer element 584 is configured on an inner mandrel 548 (not identified in FIGS. 21A, 21B) which is coupled into the production tubing 582 below an upper cup packer 586. This embodiment differs from the system 540 in that a single cup packer 586 is used rather than a combination of upper and lower cup packers. The cup packer 586 is configured to direct a gravel pack slurry from an upper wellbore annulus 588 to the wellbore annulus 590 located below the cup packer 586. The gravel pack slurry flows past the swellable packer element 584, as shown in FIG. 21A, with return fluid passing through the lower screens 581 until they are covered. When the lower screens are covered, the fluid has a preferential return path through the upper screens (not shown) flow through the lower screens 581 ceases, and the flow is diverted to pass through upper screens (not shown) located above the cup packer 586 until they too are covered with gravel pack solids.

As before, when fluid flow has ceased, gravitational settlement of the gravel pack particles will occur below the cup packer 586 in the area and below the swellable packer element 584. However, the upper packer 586 will prevent movement of gravel pack particles by gravity from the upper annular space 588 to the lower annular space 590. This provides sufficient space around the packer element 584 for it to expand into contact with the wellbore casing to provide an annular barrier and/or isolate adjacent production zones, as shown in FIG. 21B.

It will be understood that although the swellable wellbore packer elements of the embodiments described with reference to FIGS. 20 and 21 are simple swellable packer elements with expanding portions, the systems may be modified and improved by incorporating any of the techniques described above to increase the void space to allow additional displacement of gravel pack solids away from the swellable element. For example, the systems of FIGS. 20 and 21 may be used with the contracting portions, internal voids, or volume reducing proppants as described elsewhere in this specification. It will also be appreciated that although cup packers are described above, the packer systems may use substitute packers such as mechanical packers within the scope of the invention.

Figure 22C:
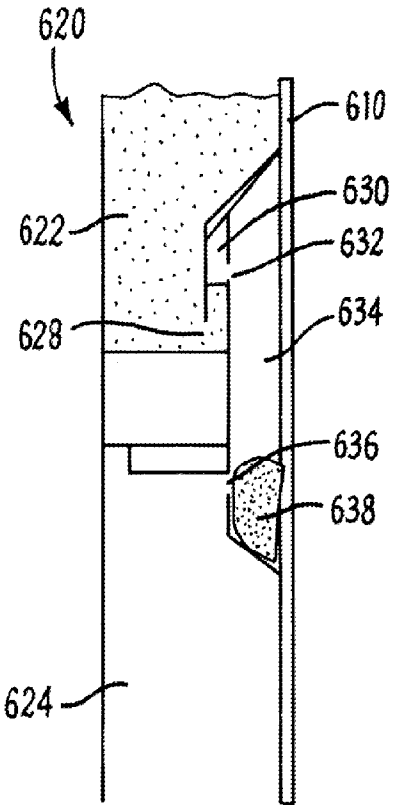
FIGS. 22B and 22C are sectional views of a detail of the mechanical packer of the packer system of FIG. 21A, respectively before and after gravel pack placement.
Figure 22B:
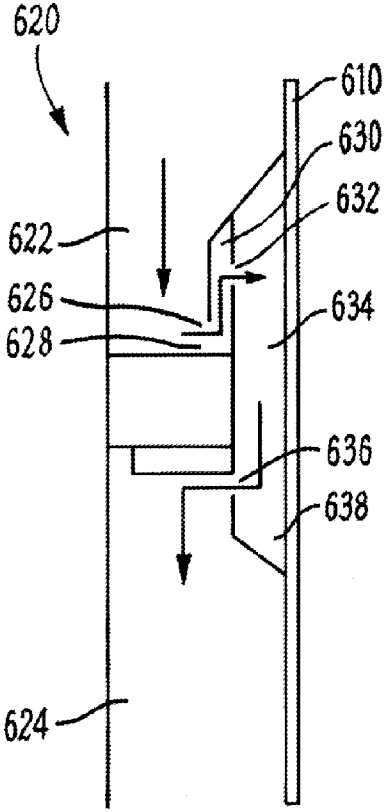
Figure 22A:
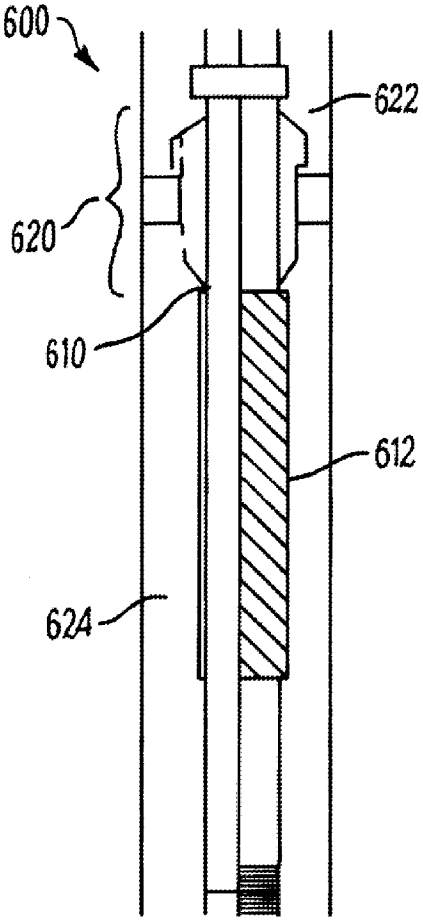
FIG. 22A is a schematic, part sectional view of a packer system in accordance with an alternative embodiment of the invention.

FIGS. 22A, 22B and 22C show schematically a specific embodiment of the invention which shows a preferred arrangement for restricting the sand volume round the swellable packer element. The system 600 of FIG. 22A will be understood from FIGS. 20A, 20B, 21A and 21B and the accompanying text. FIGS. 22B and 22C show detail of one embodiment of the bypass through the packer arrangement, indicated at 620 in FIG. 22A.

In the system 600, a packer 620 on a mandrel 610 separates an upper wellbore annulus 622 from a lower wellbore annulus 624. Beneath the mechanical packer 620 a swellable packer element 612 is located on the mandrel 610. The mechanical packer 620 includes fluid ports for gravel pack slurry to pass through the packer from the upper annulus to the lower annulus. In this embodiment, the packer 620 provides a convoluted or tortuous path 626 for the gravel pack slurry. The tortuous path 626 comprises passage through an entry port 628 into an outer chamber annular 630. The exit port 632 from the outer annular chamber is located in a vertical position above the entry port, and therefore the flow direction is required to reverse as it passes through the chamber 630. The fluid then passes into an inner annular chamber 634, in which it flows downwards to a radial exit port 636. Located below the radial exit port 636 is a collection volume 638.

During placement of a gravel pack, the gravel pack slurry is pumped through the convoluted path 626 in the packer 620 and into the wellbore annulus 624, carrying the gravel pack solids, as illustrated in FIG. 22B. Although the solid gravel pack materials can be carried with the turbulent fluid flow, when fluid flow stops (due to the lower screens being covered and fluid being diverted through the upper screens), gravity causes the solids in the fluid to fall. The fluid path 626 is tortuous enough such that the solids are inclined to bridge off at the entry port 628, with the majority of the sand in the interior of the packer 620 falling into the collection volume 638, as illustrated in FIG. 22C.

With the sand bridged above the swelling element, the lower wellbore annulus 624 around the element will have a lower proportion of solids, leaving the element sufficient space to swell and seal against the casing wall without having to rely on displacing solids into formed void.

It will be appreciated that alternative means can be used to cause the solids to bridge and prevent the passage of sand through the packer. For example, the packer could be constructed with a maze-like flow path, shielded ports, or the ports could be sized to induce the creation of arching of the sand grains at the ports to stop sand movement. It is desirable for the packer to have a surface strong and robust enough for solids to settle and build to a height sufficient for the upper zone could be completely gravel packed. In addition, the fluid entry points should be oriented so that gravity does not allow the solids to fall through the ports as the solids settle, and do not continue to fill the annulus below without the assistance of fluid flow to carry the solids.

It will be understood that the diversion of flow from a return path through lower screens to a return path through upper screens need not rely on the pressure drop resulting from the lower screens being covered, but may be assisted by the actuation of one or more valves.

It will also be appreciated that the convoluted or tortuous path packer of FIGS. 22A and 22B may also be used in a system having upper and lower packers as shown in FIGS. 20A and 20B. Although the embodiment of FIGS. 22A and 22B is described in the context of a mechanical packer, it is not limited to a specific packer type and may equally be used with an alternative packer system such as a cup packer.

Embodiments of the invention described above may be used with a range of swellable materials, including but not limited to swellable elastomers which increase in volume on exposure to hydrocarbon fluids; swellable elastomers which increase in volume on exposure to aqueous fluids; and/or to swellable materials which increase in volume on exposure to both hydrocarbon fluids and aqueous fluids (which are sometimes referred to as 'hybrid' swellable materials). The swellable material will be selected for the specific application. This is important as not all swellable materials will be compatible with all fluid types; for example, a water-swellable material may be dehydrated if used in a fluid system which has high salt content.

The invention in its various aspects provides a method and/or apparatus for multiple interval gravel pack operations and which addresses deficiencies of previously proposed methods and apparatus. In particular, the invention overcomes drawbacks of conventional single trip multi-zone systems by simplifying operations. The invention does not require a lot of specialized equipment to be installed into the wells, and does not require service tools to be repositioned for gravel packing each zone. It is not necessary to stop pumping upon the completion of one zone. The present invention in its various aspects does not rely on the use of shunt tube alternate path systems and allows the use of concentric bypass flow paths for the gravel pack slurry. The invention allows the benefits of swellable elastomer isolation systems to be enjoyed with improved simplicity and reliability. In addition, because the invention allows the gravel pack to be placed before isolation, the gravel slurry can be pumped without waiting for the swellable isolation devices to set.

The invention provides a method and apparatus for use in a wellbore gravel pack operation. The method comprises providing an apparatus in a downhole annulus. The apparatus comprises a mandrel and a swellable element formed from a material selected to increase in volume when exposed to a downhole stimulus. The method comprises placing a gravel pack below the apparatus via the downhole annulus in which the apparatus is located, and placing a gravel pack above the apparatus. Subsequent to placing the gravel packs, the swellable element is increased in volume to create an annular barrier in the wellbore. The invention allows isolation of multiple intervals of a well in a single gravel pack operation using swellable elastomers, and does not rely on the use of shunt tube alternate path systems.

Various modifications may be made within the scope of the invention as herein intended, and embodiments of the invention may include combinations of features other than those expressly claimed.

What is claimed is:

1. A swellable downhole apparatus comprising:

a mandrel; and a swellable element on the mandrel, the swellable element comprising a material selected to increase in volume when exposed to a downhole stimulus and arranged on the mandrel to swell in a wellbore annulus to provide an annular barrier between the mandrel and a surrounding wall in a wellbore; and a radially contracting portion configured to reduce a diameter of a portion of the apparatus, forming a void for accommodating a volume of solid material displaced from the wellbore annulus by the swellable element when it swells to a swollen condition, wherein the radially contracting portion comprises one or more sacrificial materials, wherein the sacrificial materials comprise materials that undergo a phase change in the wellbore annulus, decreasing a volume of the sacrificial materials.

2. The apparatus as claimed in claim 1, comprising a first condition in which the apparatus defines a first volume in the wellbore annulus, and a second condition in which the apparatus comprises the void.

3. The apparatus as claimed in claim 1, comprising one or more formations on or around the swellable element that are hardened relative to the swellable element.

4. The apparatus as claimed in claim 1, wherein the radially contracting portion further comprises:

an elastomeric matrix composed of an elastomeric material that swells under wellbore conditions, exposing the sacrificial material to wellbore fluid, wherein the elastomeric matrix binds the sacrificial material.

5. The apparatus as claimed in claim 4, wherein the sacrificial materials disperse into the solid material upon exposure to the wellbore fluid.

6. The apparatus as claimed in claim 1, comprising a plurality of contracting portions and a plurality of swellable elements arranged alternately on the mandrel.

7. The apparatus as claimed in claim 1, comprising a device for preventing or restricting solid particles of a gravel pack passing through the annulus.

8. The apparatus as claimed in claim 7, wherein the device permits passage of solids therethrough with a flow of a carrier fluid, but prevents or restricts solid particles from the gravel pack passing through the annulus in an absence of flow of the carrier fluid.

* * * * *